US012655625B1

(12) United States Patent
Hohmann, Jr.

(10) Patent No.: US 12,655,625 B1
(45) Date of Patent: Jun. 16, 2026

(54) WALL ANCHOR SYSTEM FOR CONNECTING TO A VENEER TIE

(71) Applicant: 3GEN Masonry Products, Inc., New Castle, DE (US)

(72) Inventor: Ronald Hohmann, Jr., Bradenton, FL (US)

( * ) Notice: Subject to any disclaimer, the term of this patent is extended or adjusted under 35 U.S.C. 154(b) by 163 days.

(21) Appl. No.: 18/617,834

(22) Filed: Mar. 27, 2024

(51) Int. Cl.
*E04B 1/38* (2006.01)
*E04B 1/41* (2006.01)

(52) U.S. Cl.
CPC ..... *E04B 1/4178* (2013.01)

(58) Field of Classification Search
CPC ..... E04B 1/4178
See application file for complete search history.

(56) References Cited

U.S. PATENT DOCUMENTS 3,069,919 A * 12/1962 Schultz, Jr. ..... F16H 55/44 474/169
5,035,099 A 7/1991 Lapish
5,671,578 A * 9/1997 Hohmann ..... E04B 1/4178 52/562
7,415,803 B2 8/2008 Bronner
8,037,653 B2 * 10/2011 Hohmann, Jr. ..... F16B 35/06 52/379
8,555,596 B2 10/2013 Hohmann, Jr.
D702,544 S 4/2014 Hohmann, Jr.
8,726,597 B2 5/2014 Hohmann, Jr.
D706,127 S 6/2014 Hohmann, Jr.
8,800,241 B2 * 8/2014 Hohmann, Jr. ..... E04B 2/54 52/565
8,910,445 B2 12/2014 Hohmann, Jr.
9,140,001 B1 9/2015 Hohmann, Jr.
9,273,461 B1 3/2016 Hohmann, Jr.
9,309,915 B1 4/2016 Rodenhouse et al.
9,334,646 B2 5/2016 Hohmann, Jr.
9,631,667 B2 4/2017 Rodenhouse et al.
9,758,958 B2 9/2017 Hohmann, Jr.
9,803,355 B1 10/2017 Ripley et al.
9,989,082 B2 6/2018 Rodenhouse et al.
10,151,103 B1 * 12/2018 Hohmann, Jr. ..... E04B 1/4178
10,202,754 B2 2/2019 Hohmann, Jr.
D848,250 S 5/2019 Ripley et al.
10,876,285 B1 12/2020 Wigboldy et al.
10,968,638 B1 4/2021 Hohmann, Jr.
(Continued)

FOREIGN PATENT DOCUMENTS

CA 2808917 9/2013

*Primary Examiner* — Basil S Katcheves
(74) *Attorney, Agent, or Firm* — Derek Fahey, Esq.; The Plus IP Firm, PLLC

(57) ABSTRACT

A wall anchor system for use in a cavity wall to connect to an inner wythe and an outer wythe is disclosed. The anchor wall system comprises a shaft having a first end and a second end, a washer disposed between the first end and a second end. The wall anchor system has a collar having a groove defining a pair of collar walls, the collar disposed adjacent to the washer. The wall anchor system has a holder attached to the groove of the collar, the holder comprising a receiving section for receiving a portion of a veneer tie. A maximum holder height of the holder defines a second dimension spanning from a bottom end of the holder to a top end of the holder, and the second dimension is not greater than the first dimension.

19 Claims, 19 Drawing Sheets

(56) References Cited

U.S. PATENT DOCUMENTS

| | | | | |
|---|---|---|---|---|
| 11,078,663 | B1 * | 8/2021 | Wigboldy | E04B 1/7633 |
| 11,142,915 | B1 * | 10/2021 | Hohmann, Jr. | E04B 1/4185 |
| 11,624,184 | B1 | 4/2023 | Wigboldy et al. | |
| 11,698,095 | B1 * | 7/2023 | Wigboldy | F16B 23/0007 411/371.2 |
| 2005/0279042 | A1 * | 12/2005 | Bronner | F16B 37/16 52/378 |
| 2005/0279043 | A1 | 12/2005 | Bronner | |
| 2011/0047919 | A1 | 3/2011 | Hohmann, Jr. | |
| 2011/0146195 | A1 * | 6/2011 | Hohmann, Jr. | E04B 1/4178 52/713 |
| 2012/0304576 | A1 | 12/2012 | Hohmann, Jr. | |
| 2013/0008121 | A1 | 1/2013 | Dalen | |
| 2013/0232909 | A1 | 9/2013 | Curtis et al. | |
| 2014/0055236 | A1 | 2/2014 | Kuebler et al. | |
| 2014/0075855 | A1 | 3/2014 | Hohmann, Jr. | |
| 2014/0215958 | A1 | 8/2014 | Duyvejonck et al. | |
| 2014/0260040 | A1 * | 9/2014 | Hohmann, Jr. | E04B 1/7616 52/705 |
| 2014/0260051 | A1 | 9/2014 | Hohmann, Jr. | |
| 2015/0121792 | A1 | 5/2015 | Spoo et al. | |
| 2015/0369272 | A1 | 12/2015 | Hohmann, Jr. | |
| 2016/0010325 | A1 | 1/2016 | Hohmann, Jr. | |
| 2016/0032582 | A1 | 2/2016 | Hohmann, Jr. | |
| 2016/0252129 | A1 | 9/2016 | Rodenhouse | |
| 2017/0159285 | A1 | 6/2017 | Hohmann, Jr. | |
| 2017/0204895 | A1 | 7/2017 | Rodenhouse et al. | |
| 2017/0342707 | A1 | 11/2017 | Hohmann, Jr. | |
| 2020/0263415 | A1 * | 8/2020 | Hohmann, Jr. | E04B 1/4178 |
| 2020/0378132 | A1 * | 12/2020 | Hatzinikolas | E04F 13/0805 |
| 2021/0301521 | A1 * | 9/2021 | Hohmann, Jr. | E04B 1/76 |
| 2022/0243759 | A1 * | 8/2022 | Chen | E04B 1/4178 |

* cited by examiner

WALL ANCHOR SYSTEM FOR CONNECTING TO A VENEER TIE

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not applicable.

TECHNICAL FIELD

The present invention relates to the field of anchoring systems for cavity walls, and more specifically, to the field of anchoring system for connecting inner and outer wythe of a cavity wall.

BACKGROUND

Conservation of natural resources is a crucial element in the worldwide effort to safeguard the environment and address climate change. A significant share of resource consumption is attributed to the building construction sector. Many current anchoring systems require an auxiliary wall to bear the horizontal transverse loads applied by a veneer wall. The backup wall typically consists of stud wall, masonry wall, concrete wall, steel elements, etc. Anchoring systems for cavity walls are used to secure veneer walls of a building to overcome seismic and other forces, i.e., wind shear, etc.

A veneer wall is commonly defined as a wall having a facing of masonry units (brick veneer, stone veneer, etc.), or other weather-resisting, non-combustible materials, securely attached to the backup wall, but not so bonded as to exert common action under load intentionally. The veneer wall is supported horizontally by the backup wall via veneer ties embedded in joints on one end and attached to a backup wall anchor on the other end. Typically, the veneer ties the inner wythe and the outer wythe together and is flexible for in-plane horizontal and vertical movement and rigid perpendicular to the wall face. As a result, the veneer wall and the backup wall are isolated and do not behave identically under load. While the displacements perpendicular to the wall are typically the same, the vertical flexibility provided by the veneer tie allows for differences in response to vertical loading.

Current anchoring systems utilizing veneer ties often fail to address both thermal barrier needs and stability concerns. Generally, these systems exhibit deficiencies in establishing a sufficient thermal barrier, leading to potential issues with heat retention and insulation within the building structure. Many conventional anchoring systems may lack insulation between the walls of the building, allowing for heat transfer through the structure. This can result in increased energy consumption as heating systems work harder to compensate for the loss of warmth, ultimately impacting the overall energy efficiency of the building. The stability of current anchoring systems in cold temperatures may be compromised due to inadequate design considerations for the unique challenges posed by low temperatures. Factors such as freezing temperatures and frost heave can exert additional stresses on the structure, potentially leading to reduced stability and increased vulnerability to structural damage.

Therefore, a need exists to improve over the prior art and, more particularly, for an improved anchoring system that provides enhanced thermal insulation and stability for buildings.

SUMMARY

A wall anchor system for use in a cavity wall to connect to an inner wythe and an outer wythe of the cavity wall is disclosed. This Summary is provided to introduce a selection of disclosed concepts in a simplified form that are further described below in the Detailed Description, including the drawings provided. This Summary is not intended to identify key features or essential features of the claimed subject matter. Nor is this Summary intended to be used to limit the claimed subject matter's scope.

In one embodiment, a wall anchor system comprises a shaft having a first end and a second end, a tip on the first end of the shaft, and a head on the second end of the shaft. The wall anchor system comprises a washer disposed between the tip and the head, the washer having a washer body first side, a washer body second side, and having a circumference defining a diameter defining a first dimension, and a collar having a groove defining a pair of collar walls, the collar disposed adjacent to the washer. The wall anchor system has a holder attached to the groove of the collar when the wall anchor system is in a fully assembled configuration, the holder comprising at least one receiving section for receiving a portion of a veneer tie. A maximum holder height of the holder defines a second dimension spanning from a bottom end of the holder to a top end of the holder, and the second dimension is not greater than the first dimension.

Additional aspects of the disclosed embodiment will be set forth in part in the Detailed Description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following Detailed Description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the invention and together with the description, serve to explain the principles of the disclosed embodiments. The embodiments illustrated herein are presently preferred, it being understood, however, that the invention is not limited to the precise arrangements and instrumentalities shown, wherein.

Like reference numerals refer to like parts throughout the several views of the drawings.

Figure 1A:
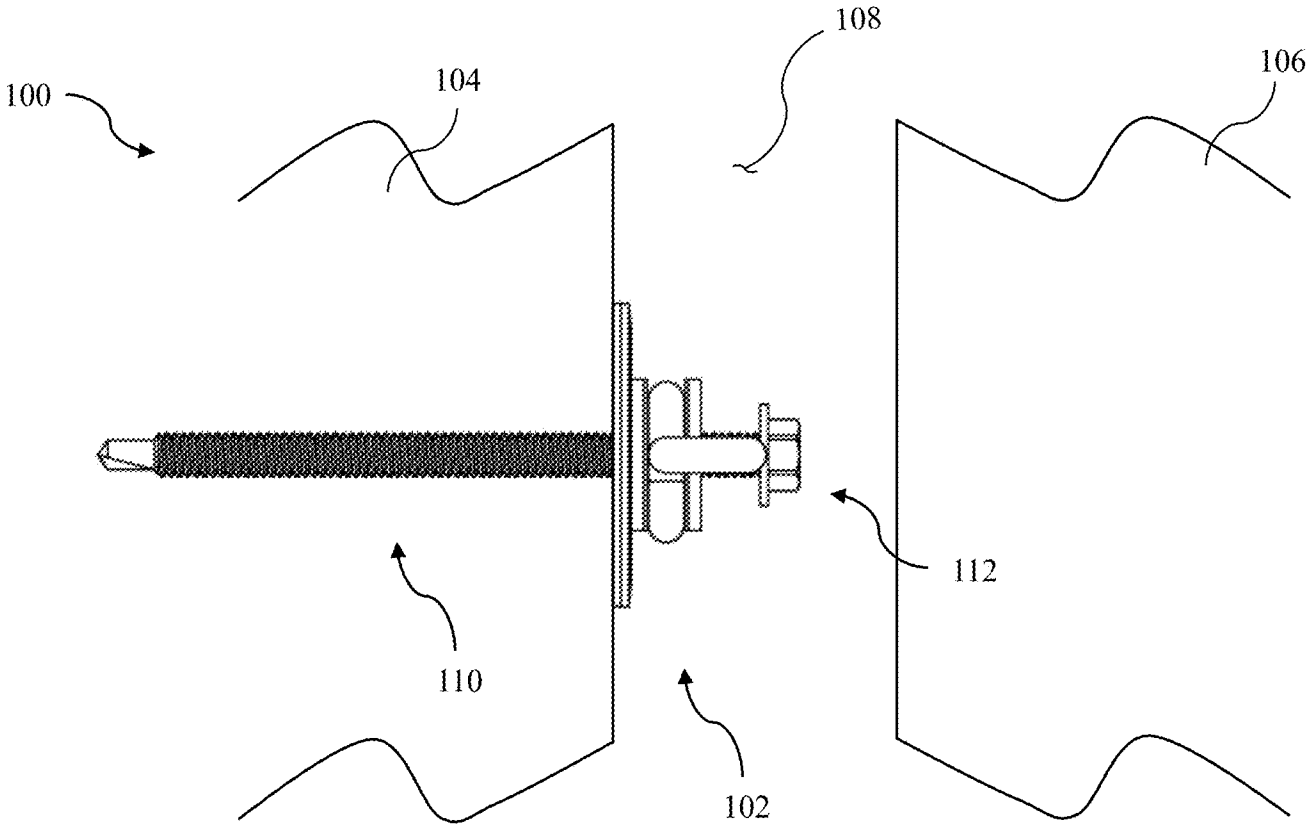
FIGS. 1A, 1B and 1C are side views of a wall anchor system for use in a cavity wall, according to a first exemplary embodiment of the present invention.

The figures herein are drawn to scale for illustrative purposes. While specific dimensions and relative proportions are depicted, it should be understood that variations and modifications to these embodiments, falling within the scope of the appended claims, are contemplated. The scaled figures are intended to facilitate a clearer understanding of the features of the disclosure and should not be construed as limiting the disclosure to the precise embodiments shown.

DETAILED DESCRIPTION

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions, or modifications may be made to the elements illustrated in the drawings, and the methods described herein may be modified by substituting reordering or adding additional stages or components to the disclosed methods and devices. Accordingly, the following detailed description does not limit the disclosed embodiments. Instead, the proper scope of the disclosed embodiments is defined by the appended claims.

The present invention improves upon the prior art by providing an enhanced wall anchor system and washer that are designed to minimize thermal conductivity between the outer and inner wythe. This helps in maintaining a more consistent temperature within the building, leading to improved energy efficiency. The disclosed wall anchor systems are designed to minimize thermal conductivity using durable materials that withstand environmental conditions and maintain their thermal performance over time. This contributes to the long-term durability and resilience of the building envelope, reducing maintenance requirements and ensuring a longer service life for the structure. The present invention further improves upon the prior art by providing an enhanced washer and holder structures that provides additional structural support to veneer ties providing stability and longevity of the structure while also preventing potential issues that could compromise the insulation over time.

The present invention provides the advantage of rotatable holders that allows for easier and more flexible installation of veneer ties. The holders and the veneer ties can be rotatably at different angles to accommodate specific requirements of the building, making the installation process more efficient. Rotatable holders allow for easy adjustment and alignment of veneer ties during installation. This flexibility ensures precise positioning, accommodating variations in wall thickness, substrate conditions, and other factors that may affect the placement of ties. Rotatable holders facilitate precise positioning of ties, minimizing the risk of misalignment or inadequate fastening that could compromise the stability of the veneer system. Rotatable holders offer versatility in design and application, accommodating various types of veneer ties and construction requirements.

Figure 1B:
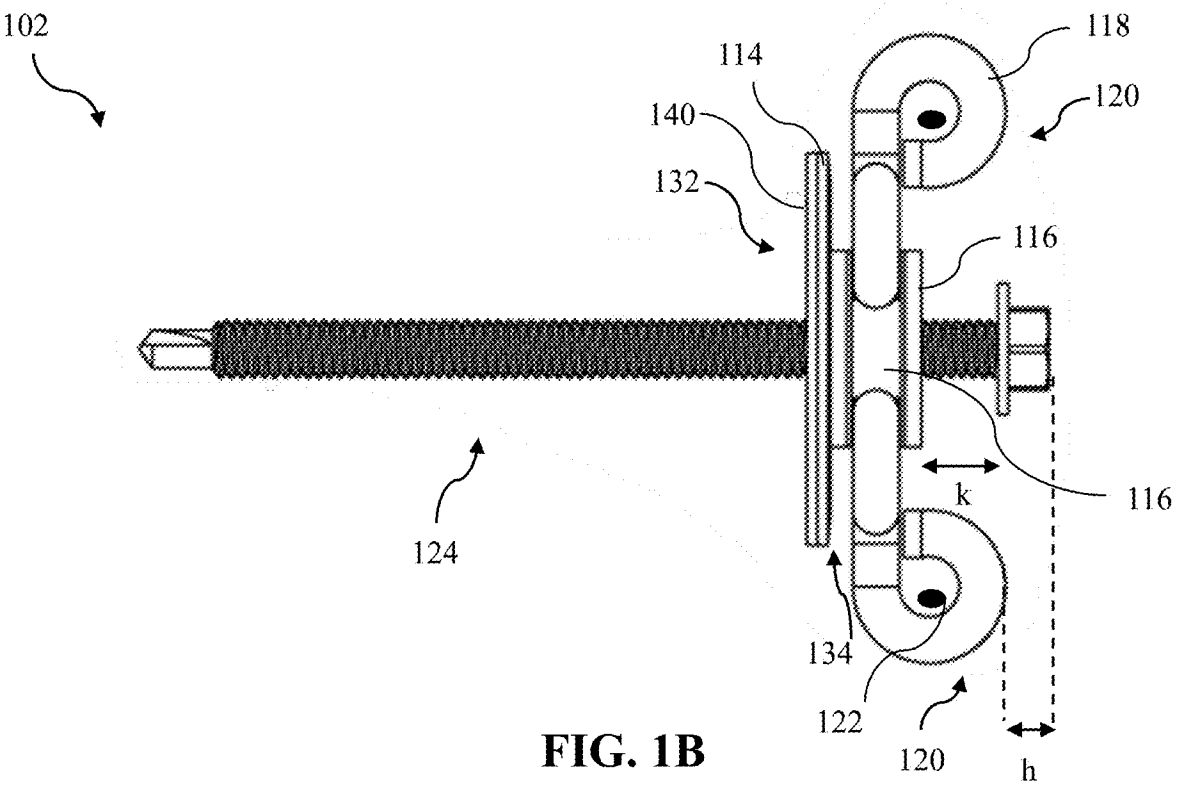

Referring now to FIGS. 1A and 1B, an example cavity wall structure environment 100 configured for a wall anchor 102 is illustrated according to an example embodiment of the present invention. Environment 100 comprises inner wythe 104 or drywall backup and outer wythe 106 or facing wall. A cavity 108 is formed in between the inner wythe 104 and the outer wythe 106. The inner wythe may comprise a single membrane or multiple membranes. The inner wythe is the layer that faces the interior of the building. The membranes with insulating properties may be integrated into the inner wythe to enhance the thermal performance of the wall. This helps regulate indoor temperatures, reduce energy consumption, and create a more comfortable living or working environment. The membranes in the inner wythe of walls serves various other functional purposes, including moisture control, thermal and sound insulation, fire resistance, and the integration of building systems. These measures contribute to the overall performance, durability, and comfort of the building.

In one embodiment, the wall anchor 102 is configured to support contact with one or more veneer ties, wall ties, or any other wire or sheet metal devices used to connect two or more masonry wythes or used to connect masonry veneers to a structural backing system. It is to be understood that structures other than environment 100 may be suitable for wall anchor 102 to be utilized without departing from the scope of the invention. The wall anchor 102 has an inner portion 110 inserted within the inner wythe 104, and an outer portion 112 that is outside the inner wythe 104 within the cavity 108.

In one embodiment, an opening within the inner wythe may comprise a threaded wall section configured to interact with a shaft 124, which may be a threaded shaft configured to interlace or interlock with the threaded wall section in order to provide efficient retention of washer body to inner wythe 104. In other embodiments, the opening may not comprise a threaded wall section. In one embodiment, the interactive configuration between the opening and shaft 124 may be accomplished by a screw, bolt, nail, rivet, or any other applicable mechanism for affixing and retaining washer body to an applicable structure. In application, shaft 124 bores or penetrates through the opening resulting in washer body being retained and subsequently washer body abuts at least a surface of inner wythe 104.

Figure 1C:
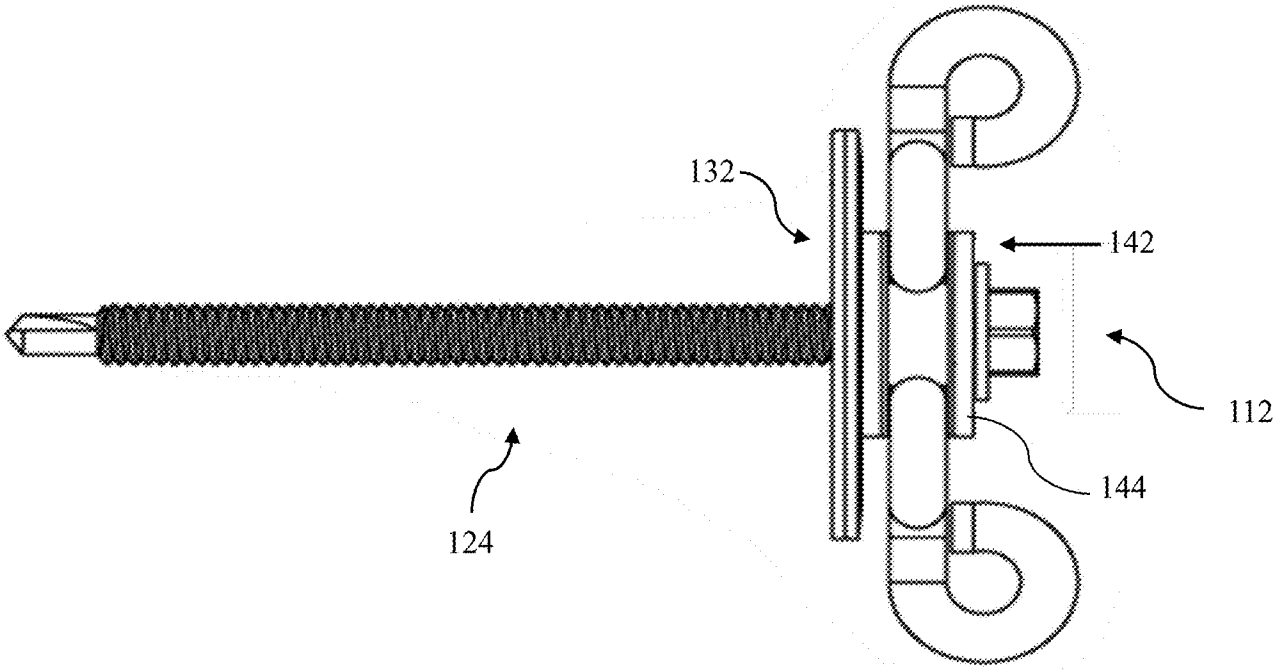

FIG. 1C illustrates an instance of the wall anchor system when the shaft is further impaled into the inner wythe such that the head of the shaft is moved along the direction 142 and the head abuts the collar wall 144 of the collar 116. In such a configuration there is no gap k, as shown in FIG. 1B, between the head portion and the collar wall.

Figure 2:
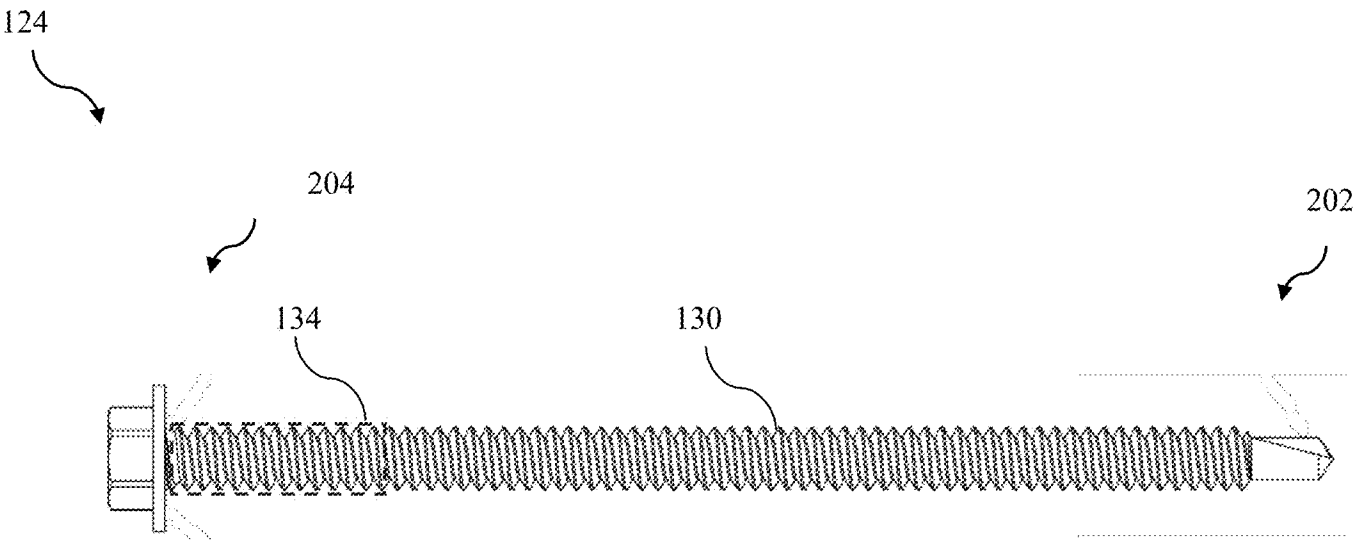
FIG. 2 is a side view of a shaft of a wall anchor system, according to a first exemplary embodiment of the present invention.

In one embodiment, the shaft 124 is a long bolt having an elongated body with a first end 202 and a second end 204, as shown in FIG. 2. The first end has the tail or tip of the shaft and the second end has the head portion of the shaft. The shaft 124 has a threaded portion 130 on the body of the shaft between the first end 202 and the second end 204, between the tip and the head, and the threaded portion extends substantially along the entire length of the shaft from the second end to the first end. There may be a shorter length of the threaded portion also covered within the embodiments of the invention. Different positions of the threaded portion on the body of the shaft may also be included in various embodiments of the present invention. For example, The threaded portion may be disposed next to the head of the shaft or may be located after a gap from the head, starting immediately after the head. In another embodiment, the threaded portion may be extended till the tail portion of the shaft. The threaded section may include different types of threading such as, Unified Thread Standard (UTS), Metric Thread Standard, acme threads, square threads, buttress threads. It is understood that different types of bolts, for example, hex head bolts, carriage bolts, eye bolts, toggle bolts, and square head bolts are covered within the scope of the present invention. As shown, a threaded section of the shaft comprises a second thermal break, that provides thermal insulation to the shaft.

In one embodiment, wall anchor 102 may comprise a washer 114, referred to as a washer body throughout the disclosure, configured to function as at least one component or as a component of wall anchor 102, and further configured to assist wall anchor 102 in utilizing a veneer tie to join inner wythe 104 to outer wythe 106. In one embodiment, the example cavity wall structure environment 100 is configured for a system for connecting one or more veneer ties designed for joining inner wythe 104 and the outer wythe 106.

In an assembled configuration, the washer is disposed between the tip and the head and defines an opening or an aperture. The opening has a threaded inner wall to receive and threadedly connect the shaft to the washer and the inner wythe. The first end of the shaft is configured to be secured to inner wythe 104 and the second end is configured to be threadedly attached with an opening associated with the washer 114, which is described in greater detail below. The opening of the washer, and the shaft have a common axis along which the shaft is inserted in the washer to couple with the inner wythe. The washer has a circumference defining a diameter defining a first dimension.

Figure 3B:
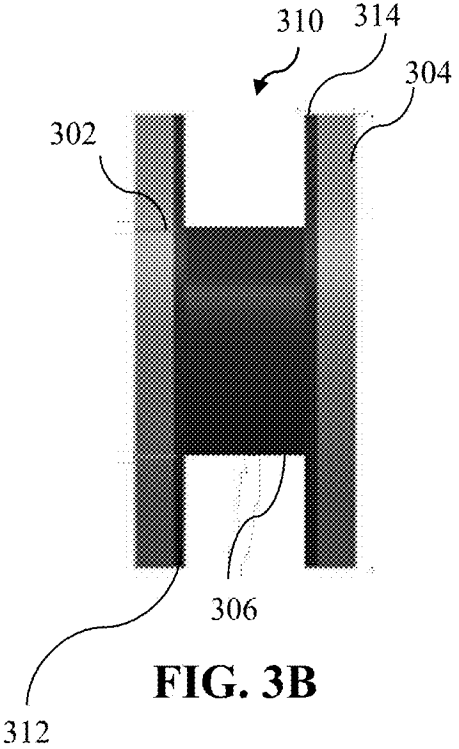
FIGS. 3A, 3B and 3C are various views of a collar of a wall anchor system, according to the first exemplary embodiment of the present invention.
Figure 3A:
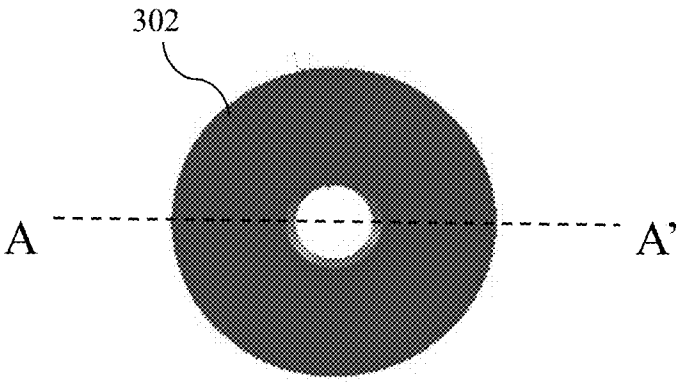
Figure 3C:
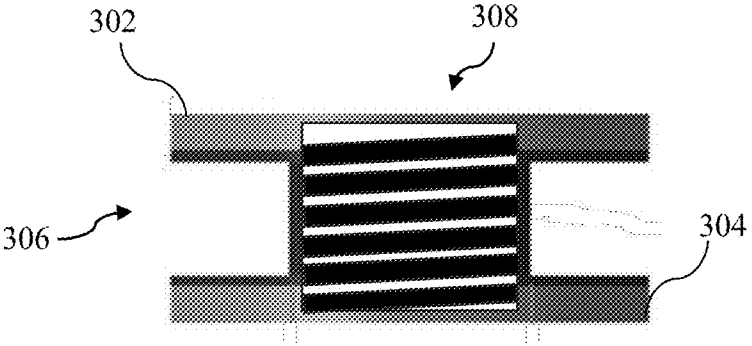

In the embodiment, as shown in FIG. 1A, the wall anchor 102 may position the washer 114 in a manner that a first side 132 of the washer abuts against the outer most surface of inner wythe 104 or one or more membranes of inner wythe 104. A second side 134 of the washer 114 is disposed opposite the first side 132 and faces the outer wythe 106. In other embodiments, the washer be attached to the inner wythe by using other methods. For example, the washer may be attached to the inner wythe without requiring a threaded hole and may be attached using welding when there are metal washers and steel structures. In another example, the washer body may be attached to the inner wythe using a bolt or other item configured to pass through a non-threaded hole that attaches the washer to the inner wythe. Adhesive anchors or epoxy may be employed to attach washers to the inner wythe by applying a specially formulated adhesive on the back or the first side of the washer, then pressing it against the inner wythe. The adhesive cures and creates a strong bond between the inner wythe and the washer. In other examples, expansion anchors, such as sleeve anchors or wedge anchors, are inserted into pre-drilled holes in the inner wythe. The first side of the washer comprises a coating 140 of a sealing material. The sealing material is configured to seal washer body against the inner wythe, generating a barrier-like structure configured to seal the connection between shaft and opening when shaft is impaled through opening. Sealing material may be composed of neoprene, EPDM, foam, Ariaprene®, rubber, or any other applicable material configured to be comprised in a washer. The sealing member has a low thermal conductivity that helps in minimizing heat transfer through the sealing member, making it an effective insulator. The sealing member exhibits resistance to a wide range of temperatures, including both high and low extremes. The sealing member remains flexible and maintains its sealing properties even in environments with significant temperature variations Further, the wall anchor 102 has a collar 116 disposed adjacent to the washer 114 as illustrated in FIGS. 3A, 3B and 3C. FIG. 3C is the sectional view of the collar 116 along the plane AA' showing the through hole 308. The collar has a groove defining a pair of collar walls, the collar disposed adjacent to the washer. The pair of collar wall 302, and collar wall 304 are separated by a tubular section 306 at the center 310. The tubular section has a through hole 308 having a threaded inner surface. In an example, the distance between the two collar walls is 0.188 mm and a depth of the collar is 0.348 mm. The pair of collar walls have a circular shape with a predefined diameter. In an example embodiment, the diameter of the through hole may be 0.375 mm and the diameter of the collar walls is 0.748 mm. The pair of collar walls are shown to have circular shape, in other embodiments, the collar walls having different shapes such as square, rectangular, oval, are also covered in the scope of the present invention. The tubular section 306 is a hollow cylindrical structure having the collar walls at the ends of the hollow cylindrical structure. In an embodiment, the tubular section 306 defines a channel extending though the collar and the washer and comprises a second threaded section.

For thermal insulation, the inner surfaces 312, 314 of both collar walls and entire outer surface of the tubular section are coated with a coating layer, such as UL94 coating or nylon coating. There may be other types of coating on the collar walls and the tubular section to provide the thermal insulation. For example, the coating can be polymer, powder coating, thermal spray coating, ceramic coating, insulating paint, or epoxy coating. On the tubular section of the collar, a thermal break is defined by thermal coating that covers a substantial portion of the groove. In some embodiments, different arrangement of the coating may be covered, such as the coating disposed only on the inner surfaces of both the collar walls, or the coating disposed on inner surface of one collar wall and the outer surface of the tubular section. The coating may be disposed to cover the entire inner surface of the collar walls and the outer surface of the tubular section 306. In another embodiment, the coating may be applied to both the inner and outer surfaces of the collar wall 302 and collar wall 304 for enhanced thermal insulation. Further, the figures illustrate one layer of coating applied on the collar 116 but it is understood that there may be more than one coating layer applied on the collar walls and the tubular section to have improved thermal insulation.

Figure 4A:
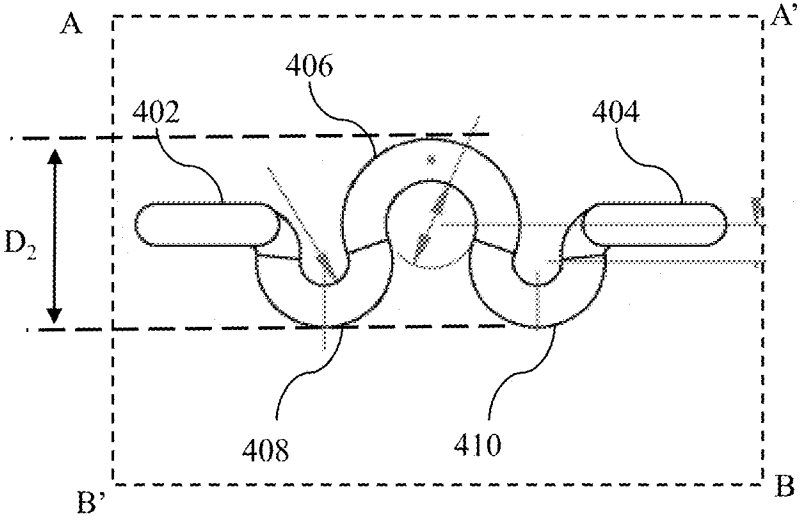
FIGS. 4A and 4B are front views of a holder of a wall anchor system, according to the first exemplary embodiment of the present invention.
Figure 4B:
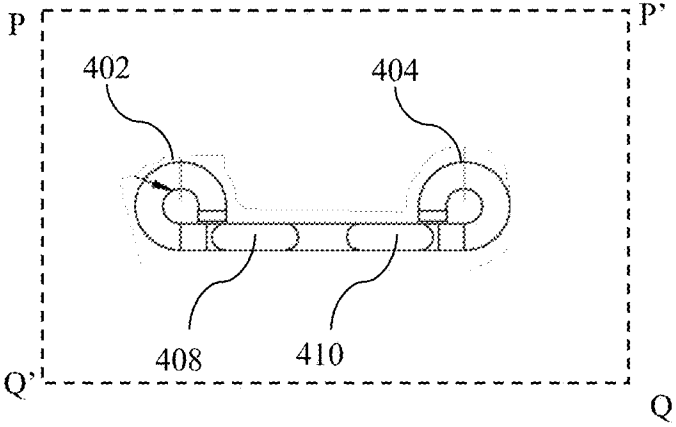
Figure 4C:
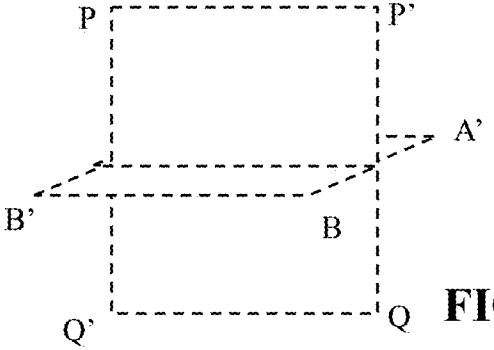
FIG. 4C illustrates two planes of a holder, according to the first exemplary embodiment of the present invention.

FIGS. 4A and 4B illustrate the holder 118 disposed adjacent to the washer of the anchor system. The holder is attached to the groove of the collar in a fully assembled configuration. The holder defines a non-planar serpentine shape. The portions 402 and 404 lie in a different plane than the portions 406, 408 and 410 and are non-planar. The portions 402 and 404 lie in the plane PP'QQ', and portions 406, 408 and 410 lie in the plane AA'BB'. FIG. 4C shows the arrangement of the two planes AA'BB' and PP'QQ' with respect to each other. The planes are transversely arranged with respect to each other. The non-planar serpentine shaped body defines a u-shaped portion disposed between a first receiving section and a second receiving section. The non-planar serpentine shaped body defines a second u-shaped portion joined with a first leg of the u-shaped portion, and a third u-shaped portion joined with a second leg or portion of the second u-shaped portion. For example, as shown in the figure, portion 408 is a u-shaped portion between the portions 402 and 406, portion 410 is a u-shaped portion in between the portions 406 and 404, and the portion 406 is a u-shaped portion between portions 408 and 410. Although shown as u-shaped portions, these portions of the holder having any other shaped portions are also covered within the scope and spirit of the present invention. As shown, the thermal break sandwiches a portion of the holder that is coupled to the groove. In one embodiment, the holder is configured to protrude or extend from sides of the collar in an assembled state. As shown in the FIGS. 1B, 4A and 4B, the holder 118 has two loop type of structures 120 at two ends of the holder. The loop type of structures define through holes as receiving sections to receive a portion of a veneer tie 122.

The holder is characterized by a series of interconnected loop formations, strategically designed for enhanced functionality and versatility. At the extremities of the serpentine form, two end loop configurations (402, 404) specifically configured for the subsequent attachment of a veneer tie, and are oriented along one plane, providing a stable and accessible point for securing the tie. These configurations allow for efficient and secure anchoring of the tie. In contrast, in the central region of the serpentine body, three additional loops (406, 408, 410) are arrayed in a staggered formation, each exhibiting a partial enclosure, and which lie on a second plane. The offset planes of the looped formations allows the end loops (402, 404) to run substantially parallel to the longitudinal axis of the screw to veneer ties to be easily secured thereto. Similarly, the second plane with the central looped formations (406, 408, 410), may be substantially perpendicular to the first plane to allow the central loops to securely fit between the head of the screw and the washer. Depending on the desired angle needed to attach the veneer tie to the holder, it is understood that angle between plane PP'QQ' may be greater than zero degrees and less than or equal to 90 degrees from plane AA'BB' such that the first plane and the second plane are offset and whereby the end loop formations are non-planar to the central loop formations.

The partial enclosure of the loops enables the loops to partially envelop the body of an elongated shaft, such as a screw, providing a secure hold against the body and head of the screw. The orientation of these central loops is deliberately may be offset, in certain embodiments, by approximately 30 degrees, with the opening of the first loop directed upwards, the subsequent loop downwards, and the final loop upwards again, creating an effective and adaptable anchoring arrangement. The holder is further engineered to allow rotational movement about the elongated shaft, enabling the optimal positioning of the tie-attaching configurations for maximum efficacy in securing the veneer tie. Additionally, the inventive design ensures that the maximum height of the holder does not exceed the diameter of a washer body within the wall anchor system, maintaining a compact and efficient profile.

Figure 5:
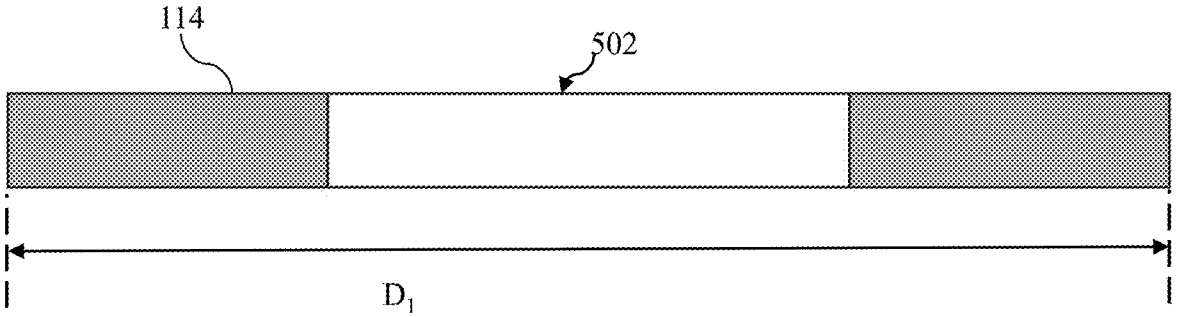
FIG. 5 is a sectional view of the washer body including a threaded opening, according to a first exemplary embodiment of the present invention.

In an embodiment, a maximum holder height of the holder defines a second dimension spanning from a bottom end of the holder to a top end of the holder. The second dimension is defined such that the second dimension is not greater than the first dimension. As shown in FIG. 5, the circumference of the washer defines a diameter $D_1$ as a first dimension, and FIG. 4A shows the maximum holder height spanning from the bottom end of the holder to the top end is $D_2$, defined as the second dimension. In the embodiment, the height $D_2$ is not greater than $D_1$. In an example, in the fully assembled configuration, the holder is attached to the groove of the collar such that the u-shaped portion 406 of the holder wraps around at least fifty percent of a cross-sectional circumference of the groove. In other words, the holder in the assembled configuration wraps around the groove to encompass more than half of the cross sectional circumference of the groove of the collar. In this manner, the holder achieves improved coupling on the collar.

In one embodiment, in the fully assembled configuration of the wall anchor system, an outermost surface of the holder does not extend beyond the head more than a maximum dimension. The maximum dimension is shown as h in FIG. 1B. The maximum dimension h is not greater than half of a maximum depth $D_2$ or height of the holder. In other words, the maximum dimension may be the depth of the holder, and the depth of the holder does not extend beyond the head of the shaft. It is understood that these figures illustrating the wall anchor systems and components of the wall anchor systems are drawn to scale.

In an example embodiment, in the fully assembled configuration, the receiving section of the holder receives a wire tie and has a circular cross-sectional shape. It is understood that different cross-sectional shapes of the wire tie other than circle are covered within the scope of the present invention. In an example, the thermal break and the second thermal break are disposed in an air cavity between the outer wythe and the inner wythe. A maximum holder height of said non-planar serpentine shaped body defines a second dimension that spans from a bottom end of the holder to a top end of the holder, and the second dimension is not greater than the first dimension of a diameter of a washer body of the wall anchor system.

FIG. 5 illustrates a sectional view of the washer 114. As shown, the washer has a circular flat body that has a through hole 502 at the center of the body. It should be appreciated that washer body may have other shapes, dimensions, and orientations that allow washer body to connect to shaft head and join inner wythe 104 and outer wythe 106, and the receiving section may be shaped, sized, and located in various arrangements that allow direct outward protrusion from washer body, such variations are within the spirit and scope of the claimed invention. In one embodiment, receiving section and/or receiving section opening may comprise neoprene or any other applicable material disposed along with the interior in order to combat degradation commonly sustained by wall anchor systems and their components. In one embodiment, washer body sides are configured to comprise a plurality of dimples, grooves, embossing, or any other applicable features known to those of ordinary skill in the art that still allows washer body to serve its intended functionality.

The washer body may be comprised of material such as carbon steel, stainless steel, aluminum, Titanium, other metals or alloys, composites, ceramics, polymeric materials such as polycarbonates, such as Acrylonitrile butadiene styrene (ABS plastic), Lexan™, and Makrolon™. The washer body may be made of other materials and is within the spirit and the disclosure. The washer body may be formed from a single piece. The components of the washer body may be manufactured from a variety of different processes including an extrusion process, a mold, welding, shearing, punching, welding, folding etc. However, other types of processes may also be used and are within the spirit and scope of the present invention.

Referring to FIGS. 6A, 6B, 6C and 6D, a second embodiment of the wall anchor system 600 installed on an inner wythe 604 is disclosed. The wall anchor system 600 is for use in a cavity wall to connect to an inner wythe 604 and an outer wythe 606 of the cavity wall defining a cavity 608 in between the inner and outer wythes. The anchor system has a shaft having a first end and a second end. In one embodiment, an opening within the inner wythe may comprise a threaded wall section configured to interact with shaft, which may be a threaded shaft configured to interlace or interlock with the threaded wall section in order to provide efficient retention of washer body to inner wythe. In other embodiments, the opening may not comprise a threaded wall section. In one embodiment, the interactive configuration between the opening and shaft may be accomplished by a screw, bolt, nail, rivet, or any other applicable mechanism for affixing and retaining washer body to an applicable structure. In application, shaft bores or penetrates through the opening resulting in washer body being retained and subsequently washer body abuts at least a surface of inner wythe.

Figure 6A:
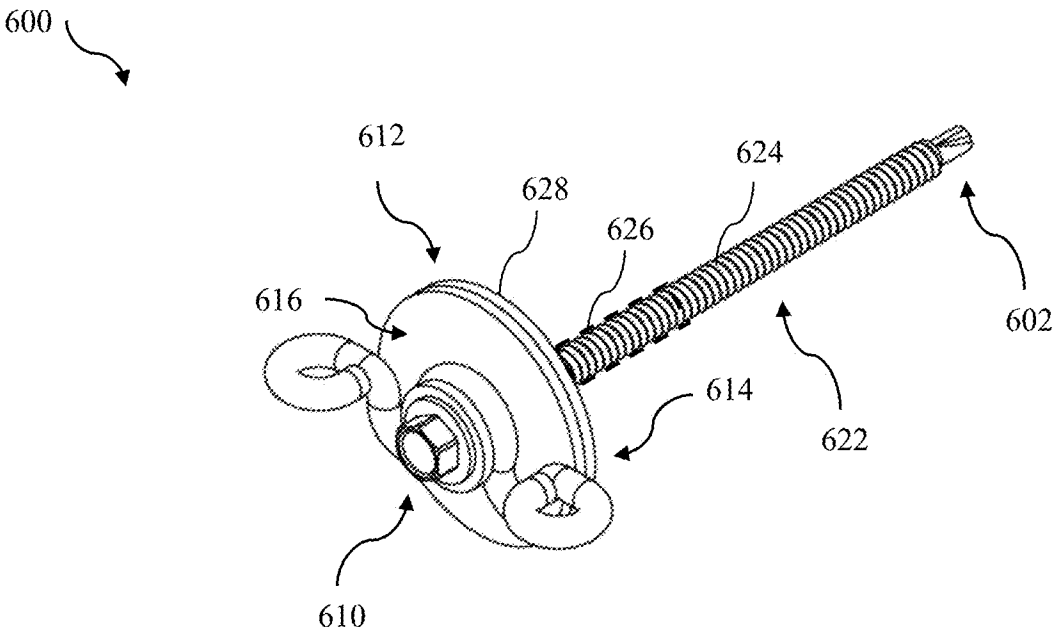
FIGS. 6A, 6B, 6C, and 6D are various views of a wall anchor system, according to a second exemplary embodiment of the present invention.
Figure 6B:
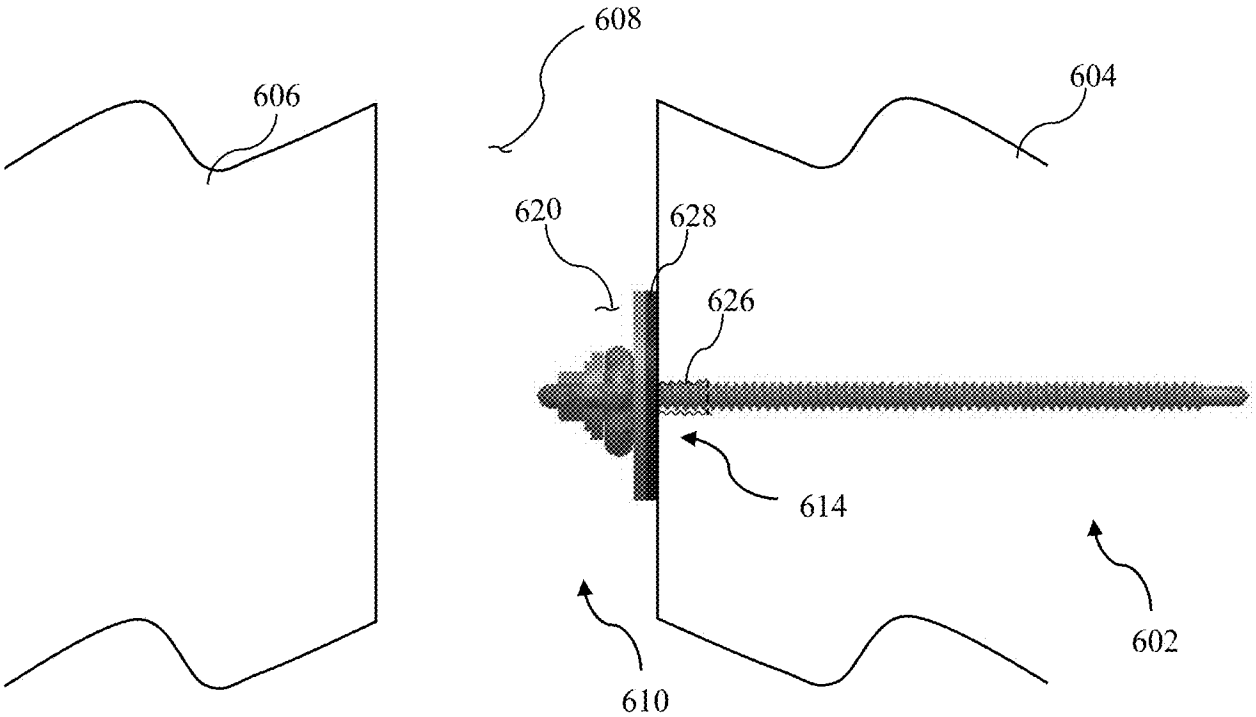

In an example, the shaft may be a long bolt having an elongated body with the first end 602 and the second end 610, as shown in FIG. 6A. The shaft 622 has a threaded section 624 on the body of the shaft between the first end 602 and the second end 610, and the threaded section extends substantially along the entire length of the shaft from the second end to the first end. As understood, the shape and structure of the shaft 622 in FIGS. 6A and 6B is similar to the shaft 124 of FIGS. 1A and 1B. The threaded section 624 of the shaft comprises a second thermal break 626. The thermal break is a thermal insulation coating on the portion of the shaft that is part of the shaft design to interrupt a direct path for heat transfer. The interruption prevents the efficient flow of heat from one side of the shaft to the other. By incorporating a thermal break, the shaft functions as a thermal barrier to thermal conduction, in applications where thermal conduction is to be minimized. Thermal break is commonly found in screws or bolts used in buildings or structures where thermal insulation is crucial. The thermal insulation coating on long bolts reduces heat transfer between the bolt and its surroundings.

The thermal coating can be a ceramic coating applied as a thin layer on the surface of threaded section of the shaft. These coatings have high thermal resistance and can withstand high temperatures. Other types of coating layers may include, polyurethane coatings, ceramic fiber coatings, epoxy-based coatings, or nylon coating.

As shown, the wall anchor system has a washer 612 disposed between the tip and the head, the washer having a first side 614, a second side 616, and having a circumference. The washer has a flat circular body having a diameter that defines a first dimension. The washer is disposed between the tip and the head and defines an opening or an aperture.

The opening has a threaded inner wall to receive and threadedly connect the shaft to the washer and the inner wythe 604. The first end of the shaft is configured to be secured to inner wythe 604 and the second end is configured to be threadedly attached with an opening associated with the washer 612. In one embodiment, each of both washer body first side 614, a second side 616 comprises sealing material coating on the first and second sides. In another embodiment, the sealing material can be coated on the entire inner surface 628 of the first side 614. The sealing material is configured to seal washer body against the inner wythe, generating a barrier-like structure configured to seal the connection between shaft and opening when shaft is impaled through opening. As described above, the sealing material may be composed of different materials, such as neoprene, EPDM, foam, Ariaprene®, rubber, or any other applicable material configured to be comprised in a washer. Some other compressible materials for seal material may include polyurethane, silicone, polyether, plastic, thermoplastic, open-cell foam, closed-cell foam, and acrylic.

The washer has a groove or a space 620 defined by a wall of the head and a second wall of the washer. The wall anchor system has a holder attached to the groove adjacent to the second side of the washer, when the wall anchor system is in a fully assembled configuration. In the embodiment, the holder is coupled to the groove and does not have the collar as shown in the wall anchor system of FIGS. 1A and 1B. The holder has two receiving sections for receiving a portion of a veneer tie or a wire tie. In an embodiment, a maximum holder height of the holder is defined as a second dimension spanning from a bottom end of the holder to a top end of the holder and the second dimension is not greater than the first dimension, as described previously.

In a fully assembled configuration and installed on the inner wythe, as shown in FIG. 6B, the wall anchor system 600 may position the washer 612 in a manner that the first side 614 of the washer 612 abuts against the outer most surface of inner wythe 604 or one or more membranes of inner wythe 604. A second side 616 of the washer 612 is disposed opposite the first side 614 and faces the outer wythe 606, and the washer disposed in the cavity 608 between the inner wythe and the outer wythe. The washer may be attached to the inner wythe by using various methods described in reference to the first embodiment in FIGS. 1A and 1B.

Figure 6D:
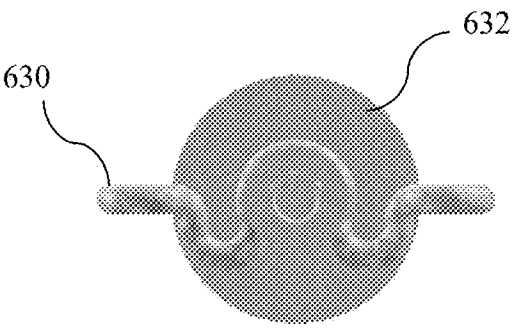
Figure 6C:
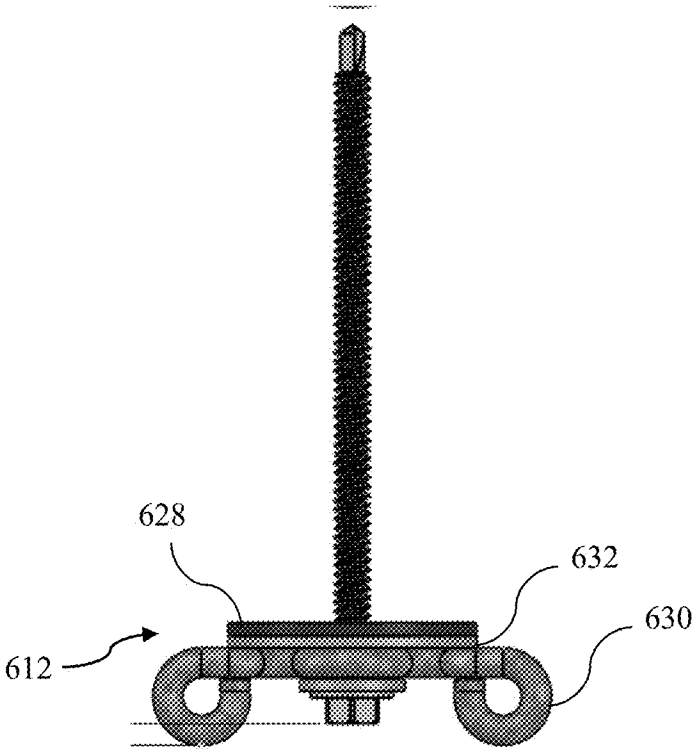

It should be appreciated that washer body may have other shapes, dimensions, and orientations that allow washer body to connect to shaft head and join inner wythe 104 and outer wythe 106, and the receiving section may be shaped, sized, and located in various arrangements that allow direct outward protrusion from washer body, such variations are within the spirit and scope of the claimed invention. In one embodiment, receiving section and/or receiving section opening may comprise neoprene or any other applicable material disposed along with the interior in order to combat degradation commonly sustained by wall anchor systems and their components. In one embodiment, washer body sides are configured to comprise a plurality of dimples, grooves, embossing, or any other applicable features known to those of ordinary skill in the art that still allows washer body to serve its intended functionality. In an embodiment, in the fully assembled configuration as shown in FIGS. 6C and 6D, the holder 630 abuts the outer surface 632 of the washer.

FIGS. 7A, 7B, 7C and 7D illustrate a washer in accordance with an embodiment of the present invention. The washer has two washer walls 704, 706 having a tubular member 726 in between the two washer walls. The tubular member has a bore or a through hole 702 having a threaded inner surface for the shaft to pass through the washer and connect to the inner wythe. The two washer walls 704 and 706 have different size and the washer wall 704 has a diameter greater than the diameter of 706. In the fully assembled configuration, the washer wall 704 abuts the outer surface of the inner wythe, and the washer wall 706 is on the opposite side disposed within the cavity between the inner wythe and the outer wythe. The holder 710 is attached to the tubular member of the washer. For thermal insulation, the outer surface 722 of the wall 704 and the inner surface 724 of the wall 706 are coated with a thermal coating to prevent conduction of the heat through the washer. The materials that may be used for thermal coating are previously described.

As shown in the figures, the holder 710 has a serpentine non-planar structure having portions 712, 714, 716, 718 and 720. Each of these portions are u-shaped portions. The holder defines a non-planar serpentine shape. The portions 712, 714, 716, 718 and 720 all lie in a different planes and are non-planar. The non-planar serpentine shaped body defines a u-shaped portion disposed between a first receiving section and a second receiving section. The non-planar serpentine shaped body defines a second u-shaped portion joined with a first leg of the u-shaped portion, and a third u-shaped portion joined with a second leg of the u-shaped portion. Although shown as u-shaped portions, these portions of the holder having any other shaped portions are also covered within the scope and spirit of the present invention. As shown, the thermal break sandwiches a portion of the holder that is coupled to the groove. In an example, the thermal coating sandwiches the wire tie to provide improved thermal insulation. The holder has two loop type of structures at two ends of the holder. The loop type of structures define through holes as receiving sections to receive a portion of a veneer tie 122.

Figure 7A:
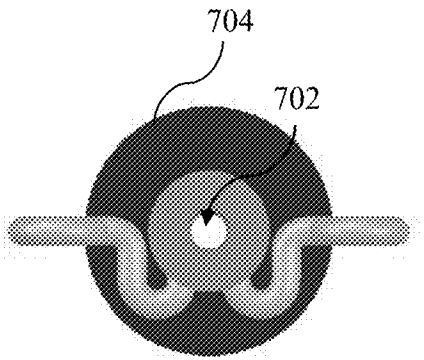
FIGS. 7A, 7B, 7C, and 7D are various views of a washer body having a holder, according to a third exemplary embodiment of the present invention.
Figure 7B:
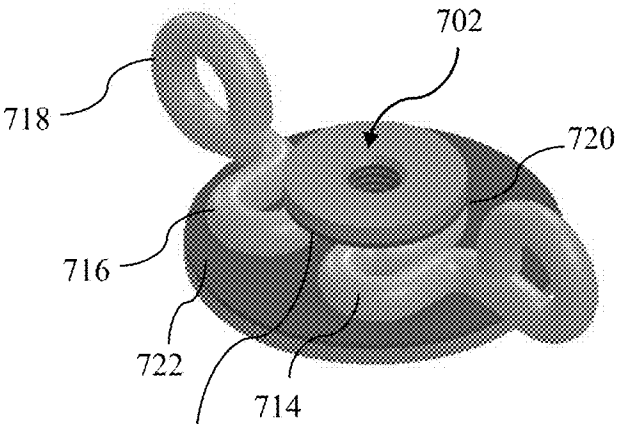
Figure 7C:
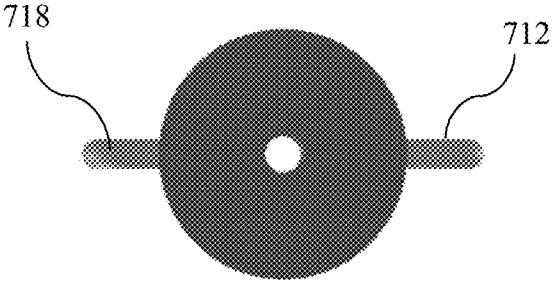
Figure 7D:
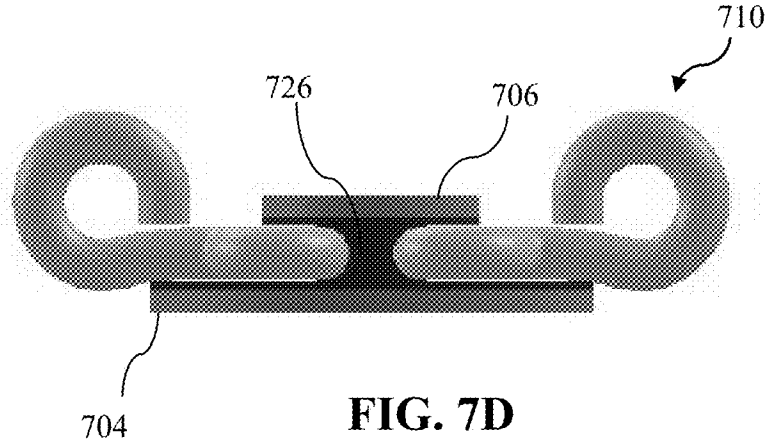

The portions 712 and 718 are the receiving sections that receive a portion of the veneer tie during installation of the wall anchor system. The portions 718 and 712 are a loop type of structure that defines a through hole in between the structure where the portion of the veneer tie is received. The portions 714, 716 and 720 are u-shaped portions such that the portion 716 is in between the portion 718 and 720, and the portion 714 is in between the portion 712 and 720. The u-shaped portion 720 is positioned in between the portions 714 and 716. In the fully assembled configuration, u-shaped portions of the holder 710 allows coupling of the holder to the tubular member of the washer. For example, as shown in FIGS. 7B and 7D the portion 720 of the holder is wrapped around the tubular member of the washer and other u-shaped portions 716 and 714 allow the holder to secure to the tubular member.

The holder 710 may be made of the same material as the washer body. The holder may be comprised of material such as carbon steel, stainless steel, aluminum, Titanium, other metals or alloys, composites, ceramics, polymeric materials such as polycarbonates, such as Acrylonitrile butadiene styrene (ABS plastic), Lexan™, and Makrolon™. The holder may be made of other materials and is within the spirit and the disclosure. The holder may be formed from a single piece. The components of the holder may be manufactured from a variety of different processes including an extrusion process, a mold, welding, shearing, punching welding, folding etc. However, other types of processes may also be used and are within the spirit and scope of the present invention. A hole is substantially centrally located within the perimeter of the washer body as depicted in the FIGS. 7A, 7B, 7C and 7D. The hole is configured for receiving a shaft that anchors the washer to the inner wythe. In some embodiments the hole may be threaded to receive the threads on the shaft. It is understood that the figures illustrating the wall anchor system and its components are drawn to scale.

Figure 8A:
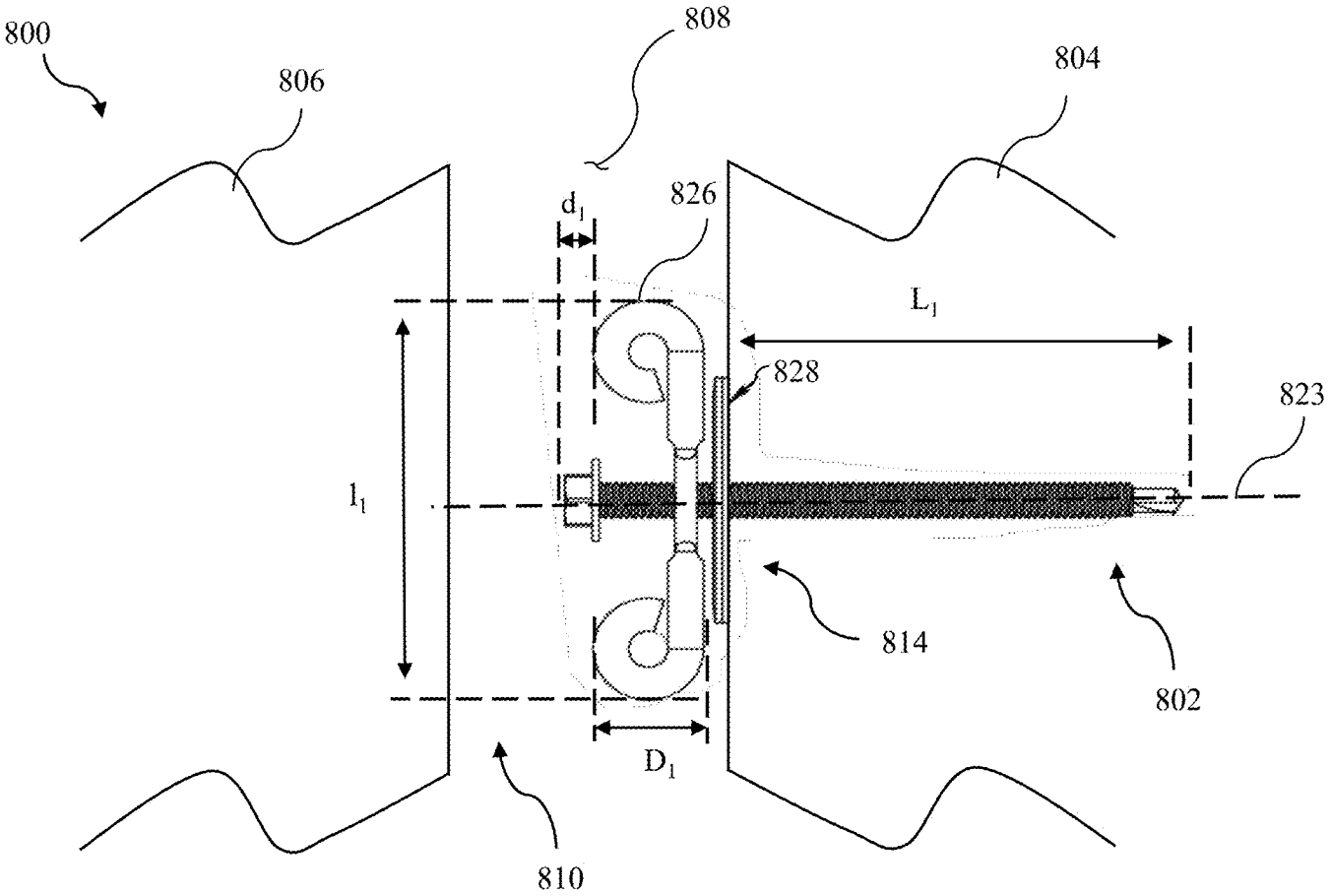
FIGS. 8A, 8B, 8C and 8D are various views of a wall anchor system and a holder, according to a fourth exemplary embodiment of the present invention.
Figure 8B:
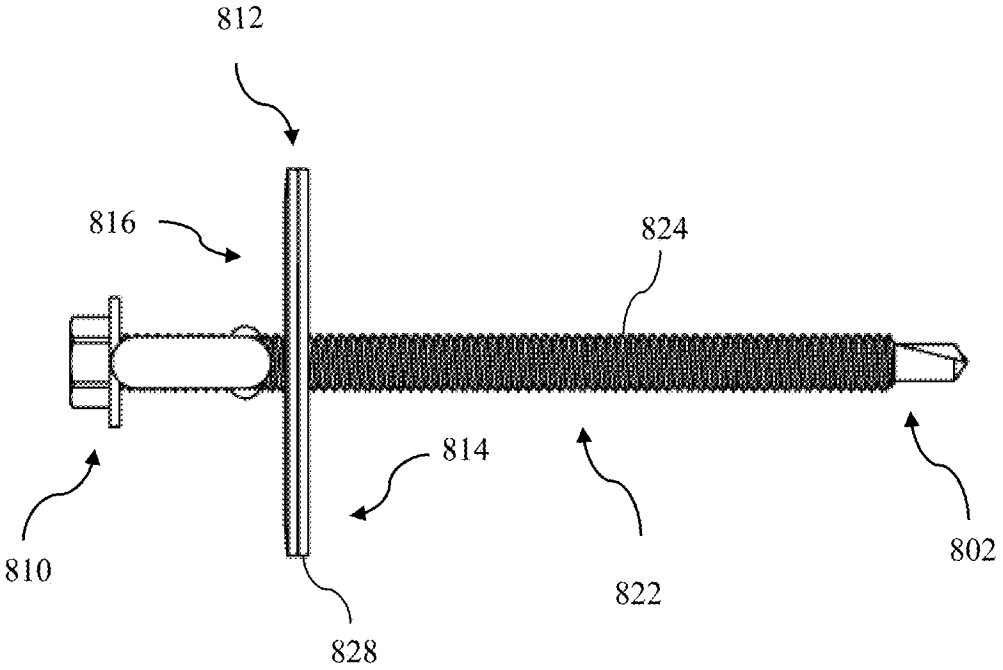

FIGS. 8A and 8B illustrate a wall anchor system 800 for use in a cavity wall to connect to an inner wythe 804 and an outer wythe 806 of the cavity wall defining a cavity 808 in between the inner and outer wythes, in accordance to another embodiment. The wall anchor system has a shaft 822, a first end 802 and a second end 810. The shaft has a threaded section 824. In one embodiment, an opening within the inner wythe may comprise a threaded wall section configured to interact with shaft, which may be a threaded shaft configured to interlace or interlock with the threaded wall section in order to provide efficient retention of washer body to inner wythe. In other examples, the opening may not comprise a threaded wall section. The interactive configuration between the opening and shaft may be accomplished by a screw, bolt, nail, rivet, or any other applicable mechanism for affixing and retaining washer body to the inner wythe. In application, the shaft bores or penetrates through the opening resulting in washer body being retained and subsequently washer body abuts the outer surface of the inner wythe. In one embodiment, an axis 823 serves as a centrally located axis, as illustrated in FIG. 8A, configured to support loosening and tightening respective to inner wythe 104 and/or shaft. It is to be understood that an axis may also be applicable to each receiving section of the holder depending upon the configuration of wall anchor. It should be appreciated that receiving section can have other shapes, dimensions, and orientations that allow the holder to connect to a portion of veneer tie, such variations are within the spirit and scope of the claimed invention. For example, receiving section may be a plurality of receiving elements manifested as extending or outward protruding tabs, flanges, or any other applicable mechanism comprising openings configured to receive the portions of the veneer tie.

In an embodiment, the shaft has a tip on the first end of the shaft, and a head on the second end of the shaft. The wall anchor system has a washer 812 disposed between the tip and the head of the shaft. The washer has a first side 814, a second side 816, and having a circumference of the defining a first dimension. In an example, the tip of the first end is a 12-24 type stainless steel carbon drill point, and the tip can be 2 mm-5 mm long. The first side 814 of the washer has a Ruspert® coating and the washer is a steel washer. The Ruspert® coating is a corrosion-resistant coating that is often applied to metal surfaces, particularly fasteners like screws and bolts. Such coatings are designed to provide protection against corrosion, rust, and other environmental factors that can degrade the integrity of metal components. These coatings are durable and can withstand harsh conditions in outdoor and corrosive environments. The process of applying such a coating involves applying a combination of layers, including a base layer, a special corrosion-resistant layer, and a topcoat.

In one embodiment, each of both washer body first side 814, a second side 816 comprises sealing material connected with structural element. The sealing material is coated on the entire inner surface 828 of the washer. Sealing material is configured to seal washer body against the inner wythe, generating a barrier-like structure configured to seal the connection between shaft and opening when shaft is impaled through opening.

Figure 8C:
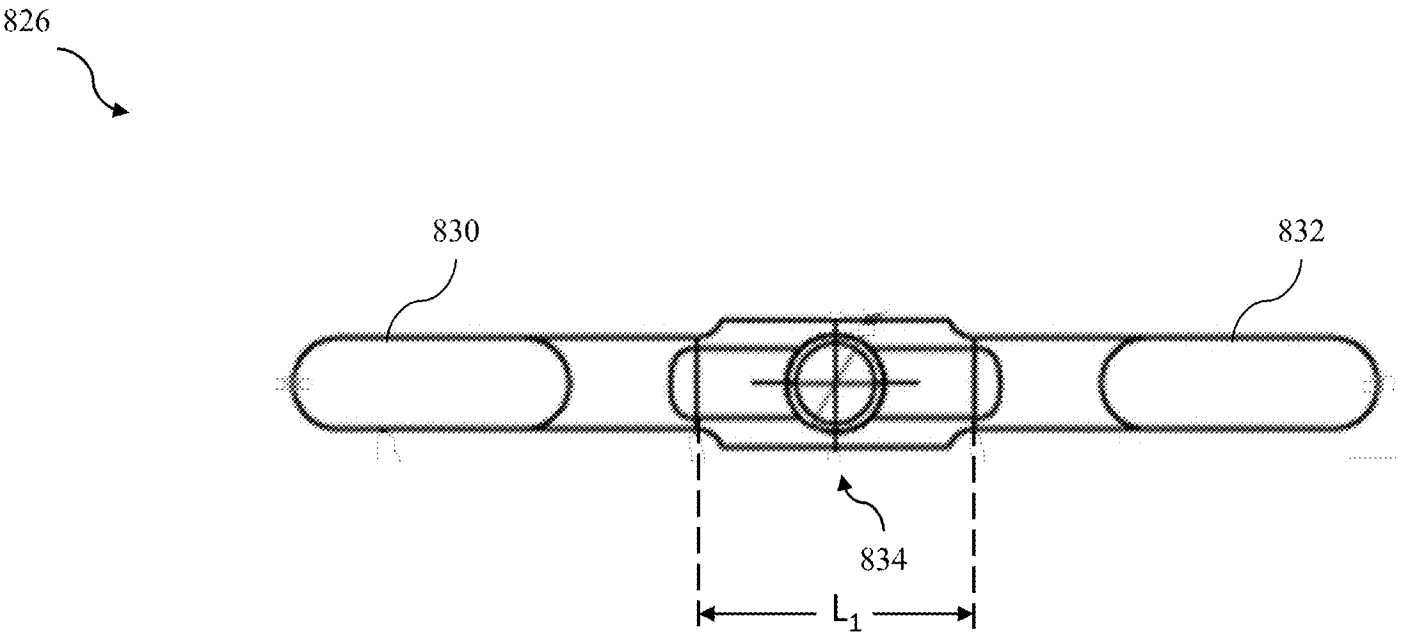

The holder 826, as shown in FIG. 8C, has a wire body having end portions 830 and 832. The end portions 830 and 832 are receiving sections having a loop structure for receiving a portion of the veneer tie. The loop structure defines a circular opening having a diameter of around 5-6 mm and the distance between the two openings of the receiving sections is 46.101 mm. The material of the holder is 304 stainless steel. In other examples, the material may be mild steel, aluminum, brass, or composite materials. The holder has a center portion having a length $L_1$. In an example, the value of $L_1$ is 0.625 mm.

Figure 8D:
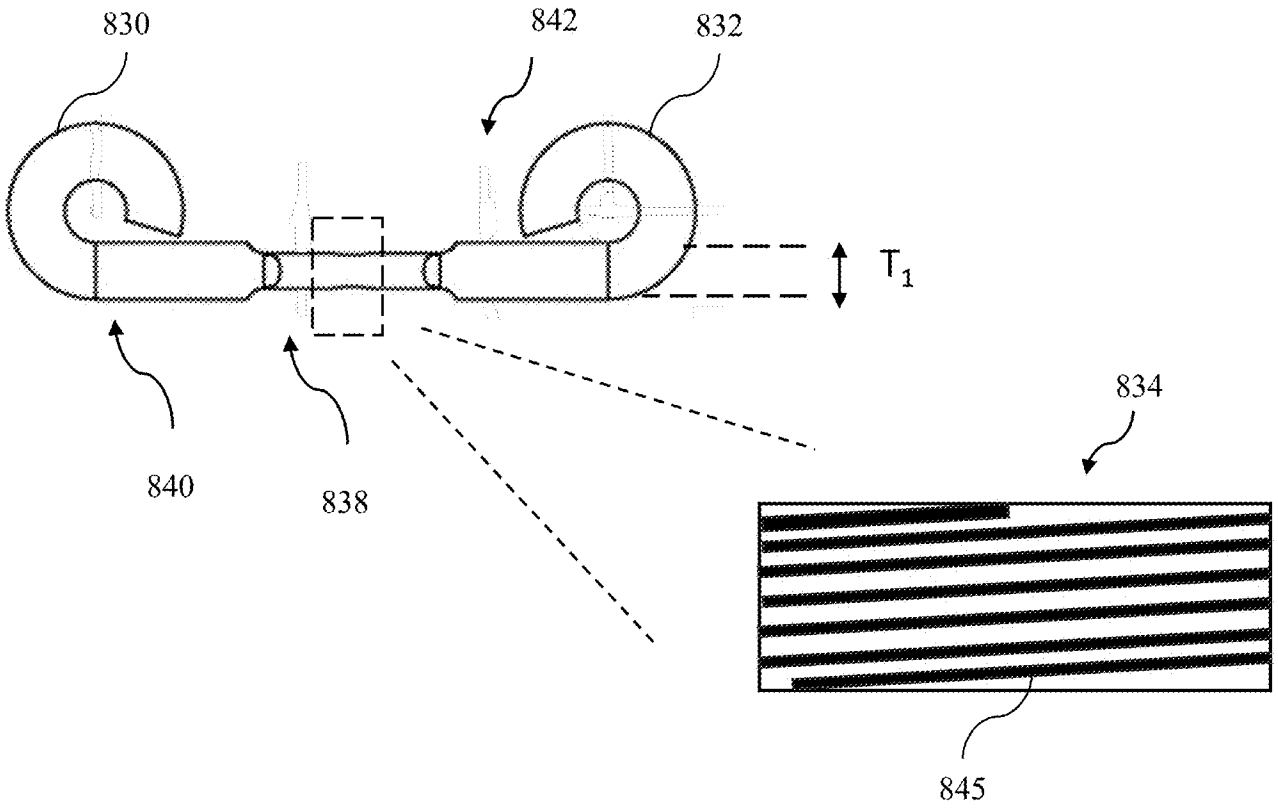

As shown in FIG. 8D, the holder has a center portion 838 and two side portions 840 and 842 extending sideways from the center portion 838, and the side portions 840 and 842 connected to the end portions 830 and 832. In an example, the thickness $T_1$ of the side portions 840 and 842 is in between 5-6 mm. Th thickness of the center portion 838 is 3.175 mm. The wire body of the holder has rounded body having a rounded cross-section. Other types of cross-sections including square, rectangular, triangular, flat or ribbon-like, or hexagonal, cross-shaped, star-shaped are also covered under the scope of the present invention. As previously described, the holder has a serpentine non-planar shape, other shapes of the holder, such as L-shaped, or U-shaped, or T shaped, or rectangular holder are also covered within the scope of the invention.

The wall anchor system has a threaded hole 834 on the wire body for receiving the shaft when the wall anchor system is in a fully assembled configuration. The threaded hole has a threaded inner wall 845, as shown in FIG. 8D. It is understood that the difference in the thickness of the center portion and the two side portions provides a better coupling of the holder with the washer. As shown, the length of the center portion is $L_1$, and different lengths of the center portion are also covered within the scope of the present invention. In other embodiments, the side portions and the center portion may have uniform thickness. It is understood that the figures illustrating the wall anchor system and its components are drawn to scale.

In certain embodiments, in the fully assembled configuration, an outermost surface of the holder of the wall anchor system does not extend beyond the head more than a maximum dimension. The maximum dimension is not greater than half of a maximum depth of the holder. The maximum dimension may be the depth of the head of the shaft or the depth of the holder, and the depth of the holder does not extend far beyond the head of the shaft. For example, as shown in FIG. 8A, the difference between the outermost surface of the holder and the head is the maximum dimension $d_1$, and $d_1$ is less than or equal to half of the depth $D_1$ of the holder. In various embodiments, the portion of the veneer tie may be hooked, attached, clamped, clasped, or any other applicable form of affixing to the receiving section of the holder without damaging or compromising the veneer tie. In another embodiment, in the fully assembled configuration a length of the holder has a dimension that is at most equal to a second length of the shaft. As shown in FIG. 8A, the length $I_1$ of the holder is at most equal to the length $L_1$ of the shaft inside the inner wythe. As shown, the inner surface 828 of the washer has the thermal coating. The thermal coating is disposed on the entire inner surface 828 of the washer and functions as thermal barrier for heat conduction between the washer, the shaft and the inner wythe.

FIGS. 9A, 9B, 9C, 9D, 9E and 9F illustrate a wall anchor system in accordance with a third embodiment of the present invention. Environment 900 comprises inner wythe 904 or drywall backup and outer wythe 906. A cavity 908 is formed in between the inner wythe and the outer wythe. The inner wythe may comprise a single membrane or multiple membranes. having insulating properties and may be integrated into the inner wythe to enhance the thermal performance of the wall. The wall anchor system has a shaft such as a long bolt having an elongated body with a first end 902 and a second end 910. The shaft comprising a tip on a first end of the shaft, a head 912 on a second end of the shaft, and a threaded portion between the tip and the head. In an example, the shaft has an integral, single-piece structure without any separable or detachable components. The threaded portion extends in a continuous manner substantially along the length of the shaft from the head to the tip of the shaft. Such a design facilitates enhanced engagement and stability when inserted into corresponding structures, offering improved load distribution and resistance against loosening.

It should be appreciated that depending on the method and application of the wall anchor, the shaft may comprise a broad range of diameters, lengths, drive styles, threads, and finishes, and such variations are within the spirit and scope of the claimed invention. It should also be appreciated that the shaft may be made of any suitable material, such as stainless steel or zinc-plated steel, or combination of materials, and may vary in accordance with the present invention. As further discussed below, the shaft may further include a high temperature coating to reduce thermal conductivity.

The wall anchor system has a holder having a barrel 907 having a threaded wall. The threaded barrel allows the shaft having the threaded portion to couple with the holder. The structure and shape of the holder is different from the other embodiments, as the holder has a generally planar side wings 909 on both sides extending laterally from the barrel. Each of the side wings 909 have an opening in the side wing. The generally planar side wings have a flanged shape located between the barrel and the receiving sections 916 and 918. In one embodiment, the side wings further includes apertures 920 and 922 configured to receive a portion of the veneer tie. In one embodiment, the aperture is defined by a circular shaped opening (two are shown) formed on the flanged section. The inner diameter of the aperture is sized and shaped according to the outer diameter of the veneer tie.

These generally planar side wings may be straight, flat sides having rectangular shape that extend from the barrel of the holder. Different shapes and size of the side wings are covered within the scope of the invention. For example, in other embodiments, the side wings may have angled edges or contours to provide better grip and anchoring in the wall. The side wings may feature curved or rounded edges. In some embodiments, the wall anchor system may have tapered wings, which facilitate easier insertion into the wall cavity and provide a secure fit, or may have contoured or irregular shapes. The length and width of the side wings may vary depending on the size and design of the wall anchor system and the veneer tie to be received by the holder. Longer and wider side wings may provide greater stability and load-bearing capacity. In some embodiments, thicker side wings that can withstand higher loads and provide increased resistance against deformation or bending under pressure may be used. The veneer tie is inserted into the aperture of the side wings to secure the veneer tie to the wall anchor. The veneer tie is configured to resist compressive and tensile loads that arise from lateral loads, such as from wind or seismic excitation. It should be appreciated that the aperture may have a variety of cross-sectional shapes and configurations, and such variations are within the spirit and scope of the claimed invention. The aperture may be manufactured from a variety of different processes such as punching, stamping, scissoring, flame cutting, laser cutting, sawing, drilling, milling, or turning.

In an embodiment, the holder is affixed to the shaft in a manner that prevents any relative movement between the holder and the shaft. The dimensions of the holder are precisely matched with the dimension of the shaft, creating a snug engagement. Such an arrangement ensures that once positioned, the holder remains immobile relative to the shaft, thereby maintaining the integrity of the anchor system within the wall. The holder can be affixed to the shaft using various techniques including screwing, welding or utilizing a snap-fit design that allows for easy assembly. Additionally, adhesive bonding or riveting can be used. For example, in riveting, a metal pin or a rivet is inserted through aligned holes in both components, creating a permanent, secure fastening.

Further, the wall anchor system has a washer 914 having a sealing element on an inner surface 926 of the first side 915 of the washer, and a thermal coating 924 disposed on a portion of the shaft. The sealing element on the first side of the washer serves the purpose of preventing the passage of fluids or gases through the anchor point. This element is typically designed to create a barrier or seal between the washer and the surface it is anchored to, ensuring a watertight or airtight connection. The sealing element maintains the integrity of the anchor point against environmental factors for example, in construction or plumbing installations. The sealing element prevents water seepage into the wall, protecting the structure from potential damage caused by moisture. Materials used for the sealing element can vary depending on the specific application and requirements. Common materials include rubber, neoprene, or other elastomers that possess resilient and impermeable properties. The design of the sealing element aims to provide a secure and durable seal, enhancing the overall performance and longevity of the wall anchor system.

Figure 9A:
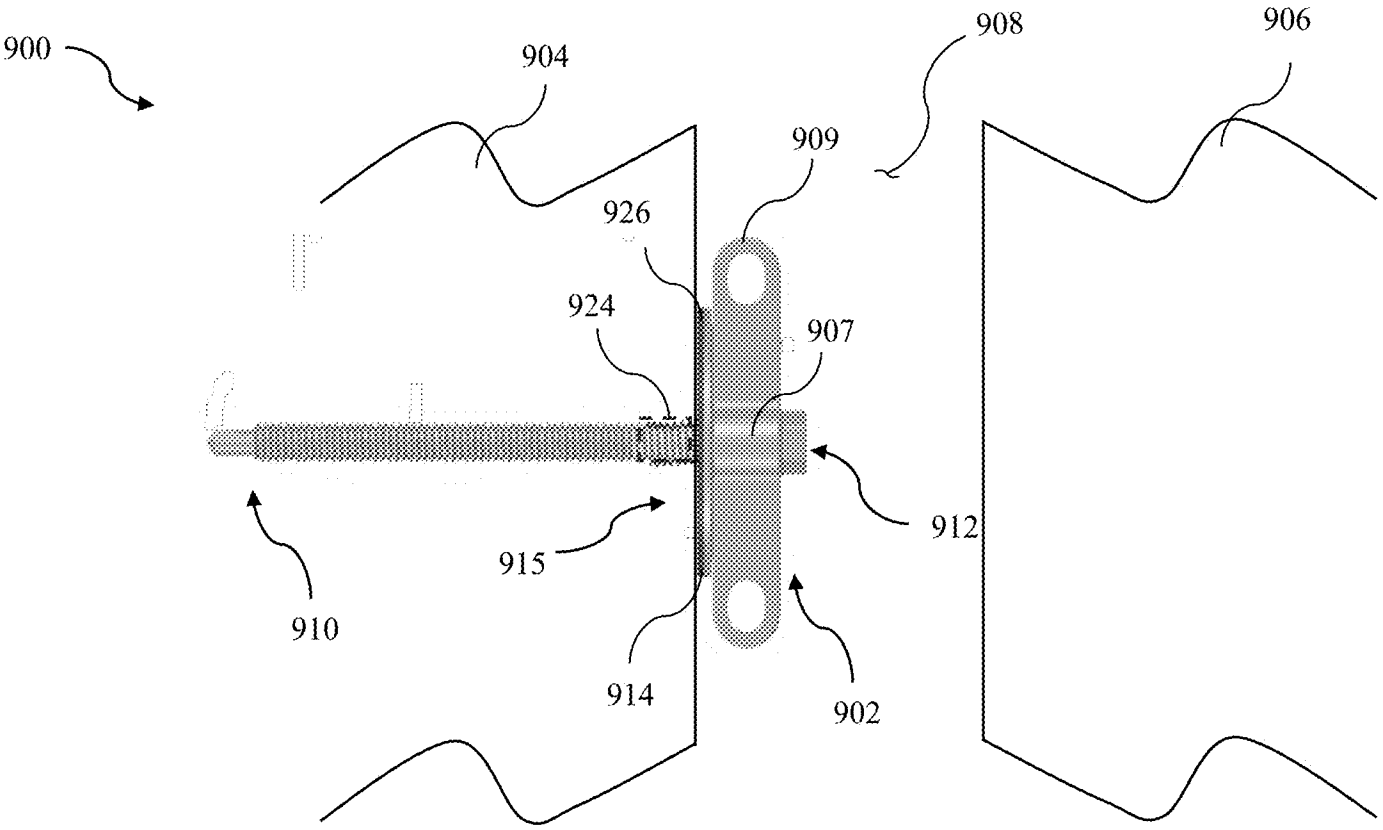
FIGS. 9A, 9B, 9C, 9D, 9E and 9F are various views of a wall anchor system and side wings, according to a fifth exemplary embodiment of the present invention.
Figure 9B:
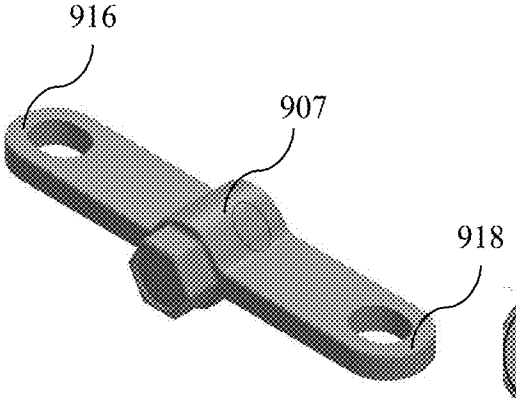
Figure 9C:
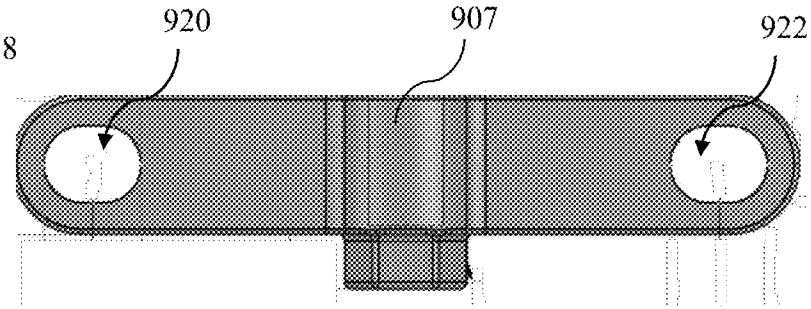
Figure 9D:
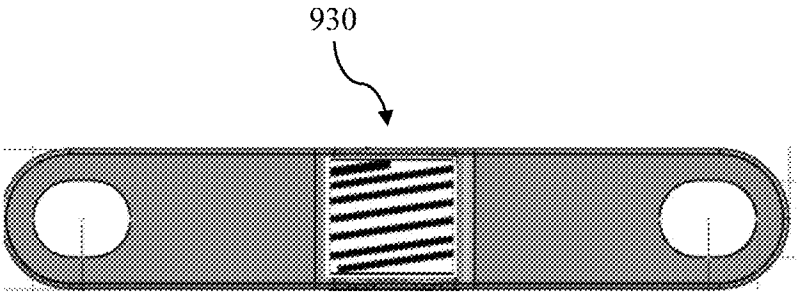
Figure 9E:
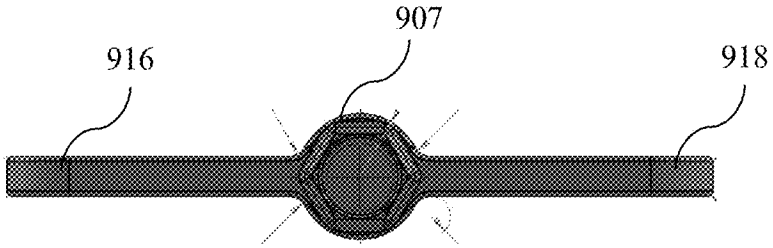
Figure 9F:
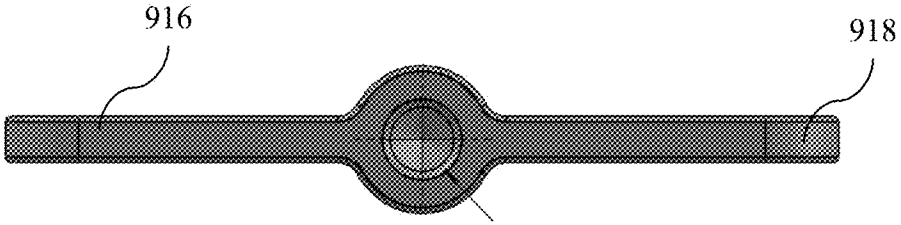

In one embodiment, the washer comprises a substantially planar circular shaped body that extends beyond the flange of the wall anchor. The washer may be comprised of a stabilizing neoprene fitting, or a bonded sealing washer, such as a sealing washer having a backing (e.g., nylon) with a bonded sealant (e.g., EPDM rubber, neoprene, silicone), or any other suitable material known in the art. It should be appreciated that the washer may be omitted from the wall anchor or may have other shapes and dimensions, and such variations are within the spirit and scope of the claimed invention. As shown, the thermal coating 924 is disposed on the portion of the shaft immediately after the washer that is inserted inside the inner wythe. There is no predetermined length of the thermal coating on the shaft, and different lengths of the thermal coating are covered within the scope of the present invention. The thermal coating 924 disposed on the portion of the shaft is designed to reduce heat transfer between the bolt and its surroundings. The thermal coating 924 can be a ceramic coating applied as a thin layer on the surface of threaded section of the shaft. These coatings have high thermal resistance and can withstand high temperatures. Other types of coating layers may include, polyurethane coatings, ceramic fiber coatings, epoxy-based coatings, or nylon coating. In certain embodiments, a portion of the veneer tie may be hooked, attached, clamped, clasped, or any other applicable form of affixing to the receiving section of the holder without damaging or compromising the veneer tie. FIG. 9D illustrates the sectional view of the holder having a through hole 930 having a threaded region.

In a fully assembled configuration the wall anchor system has the threaded portion of the shaft mating with the threaded wall of the barrel such that the holder is fixed and abuts the head. In other embodiments, the holder may be fixed to the shaft so that the holder cannot rotate relative to the shaft. In certain embodiments, the washer is attached to the shaft such that a second side of the washer abuts the holder. The first side of the washer abutting the thermal coating of the shaft defining a thermal break between the outer wythe and the inner wythe such that the opening on the generally planar side wing is configured for receiving a portion of a veneer tie in a gap between the outer wythe and the inner wythe.

In operation, the shaft is threadedly attached to opening of washer body, wherein the shaft may serve as a component of the wall anchor system. In one embodiment, the shaft first end portion associated with wall anchor assists in securing the wall anchor to the inner wythe. The shaft interacts and integrates with one or more threaded wall sections of opening, allowing washer body to be fully integrated with wall anchor. After the wall anchor has been threadedly attached to opening, the second end portion associated with wall anchor is secured to inner wythe. In one embodiment, the anchor shaft first end portion is secured to inner wythe while the anchor shaft second end portion is threadedly attached or affixed to opening in the inner wythe allowing the full body of the anchor shaft to extend from inner wythe to the cavity and/or outer wythe depending on the configuration of wall anchor. The washer body is secured to inner wythe in such a manner that washer body first side abuts against the outer most surface of inner wythe or one or more membranes of inner wythe. Thereafter, a portion of veneer tie is placed in at least one receiving section of the holder interacting with receiving section opening.

Figure 10:
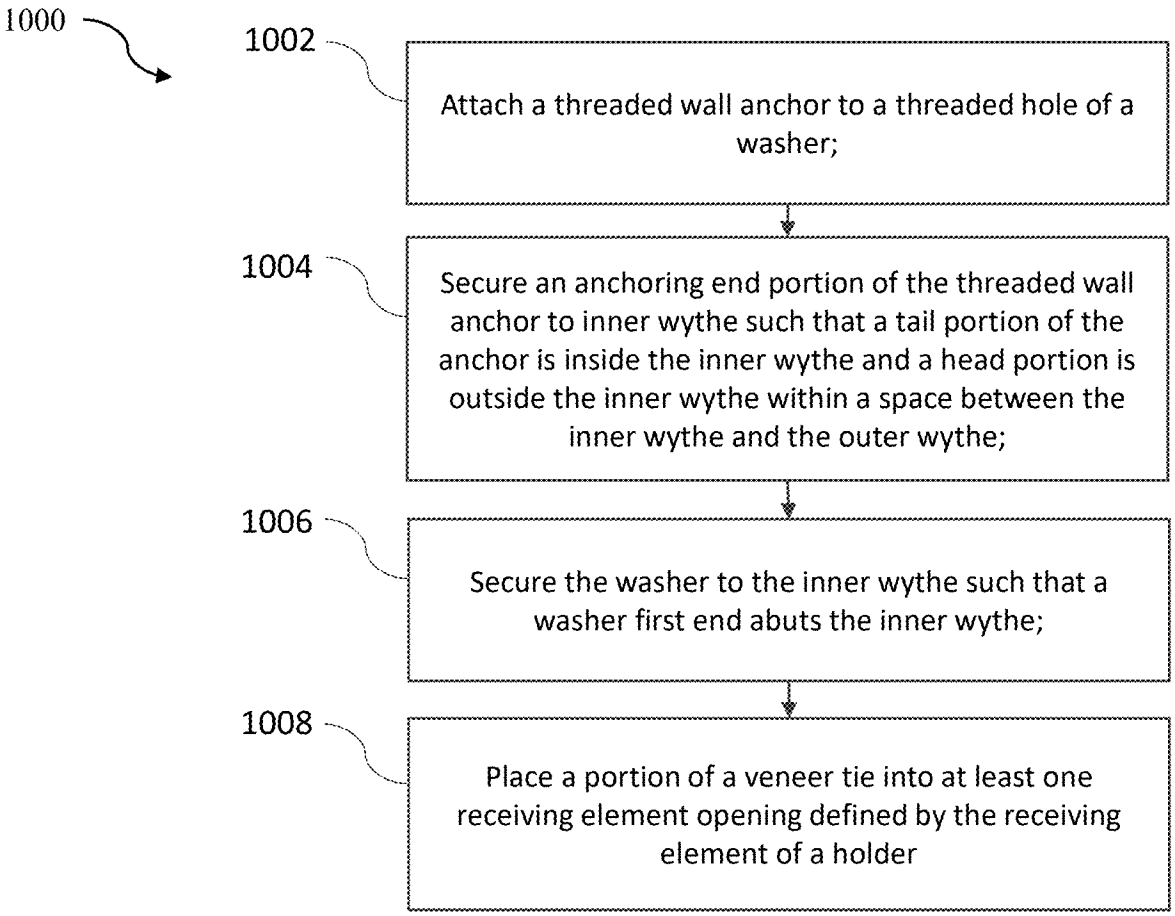
FIG. 10 is a method flowchart of placing a veneer tie into the wall anchor system, according to an exemplary embodiment of the present invention.

Referring now to FIG. 10, a method 1000 for anchoring the wall anchor systems as previously described to respective inner wythes 104, 604, 804, 904 is depicted. In step 1002, the wall anchor is threadedly attached to opening of washer, wherein wall anchor may serve as a component of an anchoring system associated with shaft. As mentioned above, in other embodiments, the opening may also be threaded. In one embodiment, the anchor shaft first end portion associated with wall anchor assists in securing wall anchor to inner wythe. The shaft interacts and integrates with one or more threaded wall sections of opening, allowing washer body to be fully integrated with wall anchor. In step 1004, once wall anchor has been threadedly attached to the opening, the second end portion associated with wall anchor, also referred to as the free end portion of wall anchor, protrudes into cavity, which is a space formed between inner wythe and outer wythe, and a portion of wall anchor is secured to inner wythe, as depicted in FIGS. 1A, 6B, 8A, 9A. In one embodiment, the anchor shaft first end portion is secured to inner wythe while the anchor shaft second end portion is threadedly attached or affixed to the opening allowing the full body of the anchor shaft to extend from inner wythe to cavity and/or outer wythe depending on the configuration of wall anchor.

As mentioned above, the washer body may also be configured to be attached using the opening that is threaded. It is to be understood that veneer tie may occupy space in both openings of the receiving sections and outer wythe subject to the configuration and length of the veneer tie. In step 1006, the washer body is secured to inner wythe in such a manner that washer body first side abuts against the outer most surface of inner wythe or one or more membranes of inner wythe. It is to be understood that at least one or more surfaces of washer body are to be abutting with at least one surface associated with inner wythe once wall anchor has successfully been threadedly attached (or otherwise attached) to opening, and anchor shaft first end secures the abutting relationship between washer body and inner wythe. In step 1008, a portion of veneer tie is placed in at least one opening of the receiving sections via the portion of veneer tie interacting with receiving section opening defined by receiving section. It is to be understood that the amount of portions of veneer tie interacting with the plurality of receiving section openings is subject to the applicable configuration of wall anchor and/or washer body. In other words, the more receiving elements available based on the configuration of washer body, the more portions of veneer tie may be hooked, interlaced or attached to the washer body via the receiving element openings.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The invention claimed is:

1. A wall anchor system for use in a cavity wall to connect to an inner wythe and an outer wythe of the cavity wall comprising:

a shaft having a first end and a second end, a tip on the first end of the shaft, and a head on the second end of the shaft;

a washer disposed between the tip and the head, the washer having a washer body first side, a washer body second side, and having a circumference defining a diameter defining a first dimension;

a collar having a groove defining a pair of collar walls, the collar disposed adjacent to the washer;

a holder attached to the groove of the collar when the wall anchor system is in a fully assembled configuration; and a first portion of the holder lying along a first plane, the first portion wrapping around the collar such that the first portion abuts at least fifty one percent of a circumference of the groove of the collar and a second portion of the holder lying along a second plane, the second plane being substantially transverse from the first plane and defining a receiving section;

a substantially closed opening defining the receiving section for receiving a veneer tie;

a maximum holder height of the holder defining a second dimension spanning from a bottom end of the holder to a top end of the holder;

wherein the second dimension is no greater than the first dimension.

2. The wall anchor system of claim 1, wherein in the fully assembled configuration a front of the wall anchor system is distal to the inner wythe, a frontmost surface of the holder defines a plane that, does not extend beyond a frontmost surface of the head more than a maximum dimension, and wherein the maximum dimension is no greater than half of a maximum depth of the holder.

3. The wall anchor system of claim 2, wherein in the fully assembled configuration the at least one receiving section receives a wire tie and has a circular cross-sectional shape.

4. The wall anchor system of claim 3, wherein a thermal break defined by thermal coating covers a substantial portion of the groove.

5. The wall anchor system of claim 4, wherein in the fully assembled configuration the thermal break sandwiches a portion of the holder.

6. The wall anchor system of claim 5, wherein a channel extending though the collar and the washer comprises a second threaded section.

7. The wall anchor system of claim 6, wherein a threaded section of the shaft comprises a second thermal break, wherein the threaded section of the shaft is disposed between the tip and the head.

8. The wall anchor system of claim 7, wherein the holder defines a non-planar serpentine shape.

9. The wall anchor system of claim 8, wherein, in the fully assembled configuration the holder wraps around at least fifty percent of a cross-sectional circumference of the groove.

10. The wall anchor system of claim 9, wherein in the fully assembled configuration the thermal break and the second thermal break are disposed in an air cavity between the outer wythe and the inner wythe.

11. A holder for receiving a veneer tie for use in a wall anchor system, wherein the holder is attachable to an inner wythe, the holder comprising:

a non-planar serpentine shaped body;

a u-shaped body defining a first portion of the non-planar serpentine shaped body, the first portion lying on a first plane;

a receiving section defined by a second portion of the non-planar serpentine shaped body, wherein the second portion lying on a second plane that is substantially transverse from the first plane, wherein the receiving section defines a substantially closed opening for receiving a portion of a veneer tie within the substantially closed opening; and a second u-shaped body defining a third portion of the non-planar serpentine shaped body, the third portion lying on the first plane and disposed between the receiving section and the u-shaped body.

12. The holder of claim 11 wherein the non-planar serpentine shaped body defines a u-shaped portion disposed between a first receiving section and a second receiving section.

13. The holder of claim 12 wherein the non-planar serpentine shaped body defines a second u-shaped portion joined with a first leg of the u-shaped portion, and a third u-shaped portion joined with a second leg of the u-shaped portion.

14. The holder of claim 13 attached to a groove defined by a first wall and a second wall such the holder wraps around at least fifty percent of a cross-sectional circumference of the groove.

15. A wall anchor system for use in a cavity wall to connect to an inner wythe and an outer wythe of the cavity wall comprising:

a shaft having a first end and a second end, a tip on the first end of the shaft, and a head on the second end of the shaft;

a washer disposed between the tip and the head;

a groove defined by a wall of the head and a second wall of the washer;

a holder attached to the groove when the wall anchor system is in a fully assembled configuration;

the holder comprising at least one receiving section for receiving a portion of a veneer tie;

a first portion of the holder lying along a first plane, the first portion wrapping around the groove; and a second portion of the holder lying along a second plane, the second plane being substantially transverse from the first plane and defining a receiving section;

a substantially closed opening defining the at least one receiving section for receiving a veneer tie.

16. A wall anchor system for use in a cavity wall to connect to an inner wythe and an outer wythe of the cavity wall, the wall anchor system comprises:

a shaft having a first end and a second end, a tip on the first end of the shaft, and a head on the second end of the shaft;

a washer disposed between the tip and the head, the washer having a first side, a second side, and having a circumference defining a first dimension;

a holder comprising:

a contiguous wire body; and a threaded hole on a first portion of the contiguous wire body receiving the shaft when the wall anchor system is in a fully assembled configuration; and a receiving section defined by a non-planar section of a second portion of the contiguous wire body curved to define a substantially closed opening for receiving a portion of a veneer tie.

17. The wall anchor system of claim 16, wherein in the fully assembled configuration the wall anchor system an outermost surface of the holder does not extend beyond the head more than a maximum dimension, and wherein the maximum dimension is no greater than half of a maximum depth of the holder.

18. The wall anchor system of claim 17, wherein in the fully assembled configuration a length of the holder has a dimension that is at most equal to a second length of the shaft.

19. A wall anchor system for use in a cavity wall to connect to an inner wythe and an outer wythe of the cavity wall comprising:

a shaft comprising a tip on a first end of the shaft, a head on a second end of the shaft, and a threaded portion between the tip and the head;

a holder comprising:

a barrel having a threaded wall having a first thermal coating;

a generally planar side wing extending laterally from the barrel; and an opening disposed on the generally planar side wing;

a washer having a sealing element on a first side of the washer; and the washer attached to the shaft such that a second side of the washer abuts the holder;

a second thermal coating disposed on a portion of the shaft wherein in a fully assembled configuration the wall anchor system comprises a thermal break defined by at least a portion of the first thermal coating of the barrel, at least a portion of the second thermal coating on the shaft, and the sealing element of the shaft.

* * * * *